US006646375B1

(12) United States Patent
Nagano

(10) Patent No.: US 6,646,375 B1
(45) Date of Patent: Nov. 11, 2003

(54) SUBSTRATE FOR SURFACE DISCHARGE AC TYPE PLASMA DISPLAY PANEL, SURFACE DISCHARGE AC TYPE PLASMA DISPLAY PANEL AND SURFACE DISCHARGE AC TYPE PLASMA DEVICE

(75) Inventor: Shinichiro Nagano, Tokyo (JP)

(73) Assignee: Mitsubishi Denki Kabushiki Kaisha, tokyo (JP)

( * ) Notice: Subject to any disclaimer, the term of this patent is extended or adjusted under 35 U.S.C. 154(b) by 349 days.

(21) Appl. No.: 09/717,108

(22) Filed: Nov. 22, 2000

(30) Foreign Application Priority Data

Nov. 24, 1999 (JP) ..... 11-332454
Oct. 18, 2000 (JP) ..... 2000-317595

(51) Int. Cl.[7] ..... H01J 17/49
(52) U.S. Cl. ..... 313/582; 313/586
(58) Field of Search ..... 313/582, 584, 313/586, 588

(56) References Cited

FOREIGN PATENT DOCUMENTS

| | | |
|---|---|---|
| JP | 4223025 | 8/1992 |
| JP | 5114362 | 5/1993 |
| JP | 08-212933 A | 8/1996 |
| JP | 8255574 | 10/1996 |
| JP | 117897 | 1/1999 |
| JP | 1125866 | 1/1999 |
| KR | 98-5226 U | 3/1998 |

*Primary Examiner*—Vip Patel
(74) *Attorney, Agent, or Firm*—Birch, Stewart, Kolasch & Birch, LLP.

(57) ABSTRACT

One end (30 (X)) of a first sustain discharge electrode (X) is disposed in a display region (21), and the other end is disposed in a second non-display region (22B). One end (30 (Y)) of a second sustain discharge electrode (Y) paired with the first sustain discharge electrode (X) is disposed in the display region (21), and the other end is disposed in a first non-display region (22A). Thereby, accidental sustain discharge in a non-display region of a surface discharge AC type PDP can be suppressed to improve quality of display.

21 Claims, 19 Drawing Sheets

SUBSTRATE FOR SURFACE DISCHARGE AC TYPE PLASMA DISPLAY PANEL, SURFACE DISCHARGE AC TYPE PLASMA DISPLAY PANEL AND SURFACE DISCHARGE AC TYPE PLASMA DEVICE

BACKGROUND OF THE INVENTION

1. Field of the Invention

The present invention relates to a surface discharge AC type plasma display panel (hereinafter, a plasma display panel is referred to simply as a "PDP") and, in particular, to a technology of suppressing error discharge in regions outside of a display region of the PDP.

2. Description of the Background Art

FIG. 9 is a perspective view in section illustrating a structure of a representative surface discharge AC type PDP disclosed in, e.g., Japanese Patent Unexamined Publication No. 11-25866 (1999). In FIG. 9, reference numeral 1 denotes a transparent electrode, numeral 2 denotes a bus electrode of which main component is metal for applying voltage to the transparent electrode 1, numeral 3 denotes a uniform dielectric layer covering the transparent electrode 1 and bus electrode 2, numeral 4 denotes a cathode film that is formed by depositing MgO, and numeral 5 denotes a front glass substrate (i.e., a substrate for a front panel or a substrate body) mounting on its main surface these components 1, 2, 3 and 4.

Numeral 6 denotes an address electrode crossing the bus electrodes 2 at right angles at different levels, numeral 10 denotes a uniform over-glaze layer covering the address electrodes 6, numeral 7 denotes a barrier rib for partitioning lanes of which display pattern is defined by each address electrode 6, numeral 8 denotes a phosphor formed on the wall of the barrier rib 7, and alphabets R, G and B accompanying each numeral 8 denote the color of phosphors of red, green and blue, respectively. Numeral 9 denotes a rear glass substrate (i.e., a substrate for a rear panel, or a substrate body) mounting on its main surface these components 6, 7, 8 and 10. By arranging so that the top of the barrier rib 7 is adjacent to the cathode film 4, there are formed discharge spaces surrounded by the phosphors 8 and cathode film 4, each discharge space being filled with a mixed gas such as of Ne+Xe.

In this construction, a single scanning line is made up of a pair of the transparent electrodes 1 and bus electrodes 2, namely a pair of sustain discharge electrodes (X, Y), as shown in FIG. 9. Therefore, each sustain discharge electrode has a metal electrode part la wherein the bus electrode 2 is mounted on the transparent electrode 1, and a transparent part 1*b* wherein no bus electrode 2 is mounted thereon.

FIG. 10 is a perspective view in section illustrating a structure of a discharge cell in another surface discharge AC type PDP. In FIG. 10 the same reference numerals 1 to 10 are used as in FIG. 9 for similar parts. In the PDP of FIG. 10, an address electrode 6, an over-glaze layer 10, a pair of sustain discharge electrodes X and Y each of which has no transparent electrode and is made up of a bus electrode 2 alone, a dielectric layer 3, and a cathode film 4 are formed in the order named on the main surface of a rear glass substrate 9. A barrier rib 7 and a phosphor 8 are formed on the main surface of the front glass substrate 5. Each discharge space where the barrier rib 7 and cathode film 4 are in contact for making a lane-like partition is filled with a discharge gas.

In the discharge cell structure of FIG. 9 or FIG. 10, a discharge cell 14 is formed by the point where the lane associated with drive of an arbitrary address electrode 6 defined by two adjacent barrier ribs 7 intersects an arbitrary scanning line defined by a pair of the sustain discharge electrodes (X, Y). By aligning such discharge cell 14 in matrix, a display region 21 of the surface discharge AC type PDP is formed as shown in FIG. 11. Here, in general, the display region in the direction of extension of the sustain discharge electrode X or Y is usually defined as a region sandwiched by core lines of outermost barrier ribs 7*a* in the alignment of the barrier ribs 7 that partition and define plural lanes associated with plural address electrodes 6 to which ON/OFF signal based on an image data is inputted. However, the outermost barrier ribs 7*a* are indispensable in defining the display region. Therefore, in the present invention, a display region 21 in the direction of extension of the sustain discharge electrode X or Y is to be defined as a region including the overall width of both outermost barrier ribs 7. Non-display region 22 is defined as a region that contains no outermost barrier ribs 7 and makes contact with the display region 22. As schematically shown in FIG. 12, when the PDP is viewed from front of the front panel, for convenience, the non-display region 22 on the right side is defined as a first non-display region 22A, and the non-display region 22 on the left side is defined as a second non-display region 22B.

Since the outermost barrier ribs 7*a* have no gas space necessary for occurrence of accidental discharge, which will be later raised as a problem, it is appropriate to interpret based on the non-display region 22 as defined above, even in a known technology to be described later which has been proposed to achieve the object of suppressing accidental discharge within the non-display region 22.

To project a desired image on the display region 21 of the surface discharge AC type PDP shown in FIG. 11, the following system is generally employed. That is, during writing operation, according to the image data, wall charges of different polarities are selectively stored in a portion of a surface 4S of the cathode film 4 to which the sustain discharge electrode pair (X, Y) is projected, the cathode film 4 being above the sustain discharge electrode pair (X, Y), in each discharge cell 14. In the succeeding sustain operation, alternating pulses are applied a predetermined number of times to between the sustain discharge electrode pair X and Y, and sustain discharge is performed a predetermined number of times only by the discharge cell 14 that has stored the wall charges in the previous writing operation. When the sustain operation is completed, the next selective writing operation is then performed through an erasing operation for resetting the wall charges remaining in the discharge cell 14 in which the sustain discharge was performed. The desired image is obtained by repeating a sequence of these selective writing operation, sustain operation and erasing operation.

In the selective writing operation, the applied voltage to the sustain discharge electrode pair X and Y is scanned to select one scanning line at a time, and the voltages corresponding to ON/OFF signals of the image data in the scanning line selected synchronously are outputted to a series of address electrodes 6. On the selected scanning line, in the discharge cell 14 in which a voltage equivalent to ON is applied to the associated address electrode 6, a surface discharge of writing occurs between the sustain discharge electrode pair (X, Y), thereby to store the wall charges necessary for occurrence of sustain discharge in the succeeding sustain operation. On the other hand, even on the selected scanning line, in the discharge cell 14 in which a voltage equivalent to OFF is applied to the associated address electrode 6, no surface discharge of writing occurs and thus no wall discharge is stored. Therefore, this discharge cell 14 becomes an OFF cell causing no sustain discharge in the succeeding sustain operation.

Referring again to FIG. 11, the sustain discharge electrode pairs (X, Y) have a portion extending to the non-display region 22 that is not associated with drive performed by a series of address electrodes 6. Since this portion is in the non-display region, it is desirable that no sustain discharge occurs. At this portion, however, it is impossible to perform the drive control by means of the address electrodes 6, and therefore, during a sequence of the above-mentioned operations, accidental sustain discharge happens to start at the portions of the sustain discharge electrode pair (X, Y) which extend to the non-display region 22. Especially at the time of writing operation, when the ON state voltages based on an image information are applied to address electrodes 6*a* which the outermost lanes of the display region 21 are associated with, the ON state voltages of the address electrodes 6*a* exert some influence on the field formation in gas spaces within the non-display regions 22 adjacent to the outermost lanes via one barrier rib 7*a*. As a result, error writing discharge occurs in each of the non-display regions 22 and it tends to cause error sustain discharge in the succeeding sustain operation.

As a conventional technique of suppressing such accidental sustain discharge caused in the non-display regions 22, there are the followings.

A first technique is one which is disclosed in, e.g., Japanese Patent Unexamined Publication No. 5-114362 (1993). The first prior art discloses a method in which the width of space between the sustain discharge electrode pair (X, Y) constituting one scanning line is set wider at the portion extending to the non-display region. This method utilizes the characteristic that as the width of space between the sustain discharge electrode pair X and Y is increased, the electric field strength between the electrodes X and Y to be formed in the discharge space near an upper part of the space between the electrodes X and Y is weakened thereby to make it difficult to cause sustain discharge therebetween.

A second technique is one which is disclosed in, e.g., Japanese Patent Unexamined Publication No. 8-255574 (1996). The second prior art discloses a method in which dummy address electrodes corresponding to the portions of sustain discharge electrode pairs X and Y which extend to the non-display region are provided respectively, and, during writing operation, voltages equivalent to an OFF level are always applied to the dummy address electrodes, thereby the same outputs as the address electrodes within the display region are also applied to the dummy address electrodes during sustain operation and erasing operation. With this method, the dummy address electrodes can function to control discharge within the non-display region in precisely the same fashion as the address electrodes do within the display region. This results in that discharge in the non-display region is always in OFF state.

However, both methods of the conventional techniques have the following drawbacks.

Drawback I: As a practical matter, it is usually difficult to suppress accidental sustain discharge in the non-display region by means of the method described in Japanese Patent Unexamined Publication No. 5-114362. The reason for this is as follows. In the display region, the strength of electric field that sustain discharge electrode pair forms in a gas space is always suppressed by that the address electrodes maintain a predetermined potential. Whereas in the non-display region, absence of such suppression by the presence of the potential of the address electrodes makes it easy to form a stronger electric field strength between the sustain discharge electrode pair than the display region. Therefore, even if it is tried to suppress accidental discharge by increasing the width of space between the sustain discharge electrode pair, it is usually impossible to obtain a sufficiently wide space in a predetermined alignment pitch of scanning lines.

Drawback II: With the method described in Japanese Patent Unexamined Publication No. 8-255574, the dummy address electrodes maintain a predetermined potential so that the strength of electric field between the sustain discharge electrode pair in the non-display region is suppressed in the same fashion as that in the display region. This enables to suppress sustain discharge in the non-display region under the same condition as in OFF cells in the display region. In this method, however, one or more dummy address electrodes are needed for each of the non-display regions 22A and 22B shown in FIG. 12, in order to drive these dummy address electrodes. The objective can be achieved by bringing the data corresponding to the dummy address electrodes into always OFF during writing operation, with the arrangement that the dummy address electrodes are connected to the output bits of a data driver IC as in the address electrodes for the display region 21 shown in FIG. 12. However, from the point of view of effective display pixel number required for a standard full color PDP, the number of necessary address electrodes is 1920 pieces for VGA, 3072 pieces for XGA, 3840 pieces for SXGA, and 5760 pieces for full-spec HDTV. That is, the output bit number per one general-purpose data IC for PDP can be divided by any one of 64, 96 and 128. It is therefore necessary to increase at least one data IC in order to drive the dummy address electrodes, thus raising the cost. It can be considered to provide exterior electrode terminals corresponding to the dummy address electrodes in addition to the output bits of data IC, in order to avoid the cost increase. Even with this construction, it is however necessary to further provide outputs corresponding to a sequence of erasing operation, writing operation that always corresponds to OFF, and sustain operation, in addition to the outputs of data IC. This case also raises the cost in terms of circuit wiring and signal processing, thus failing to settle the drawback radically.

SUMMARY OF THE INVENTION

A first aspect of the invention is directed to a substrate being used for a surface discharge AC type plasma display panel wherein a discharge cell is formed by each intersecting point of each lane and each scanning line, the each lane being partitioned by barrier ribs adjacent to each other within a plurality of barrier ribs provided to extend in a first direction and being associated with drive of an address electrode corresponding to the barrier ribs adjacent to each other within a plurality of address electrodes provided to extend in the first direction, and the each scanning line being defined by an arbitrary sustain discharge electrode pair within a plurality of sustain discharge electrode pairs provided to extend in a second direction orthogonal to the first direction, and a display region defines the discharge cell aligned in matrix, the substrate comprising: a substrate body; the plurality of sustain discharge electrode pairs formed on the substrate body; a dielectric layer formed on the substrate body and covering the plurality of sustain discharge electrode pairs; and a cathode film formed on the dielectric layer, wherein each of the plurality of sustain discharge electrode pairs comprises first and second sustain discharge electrodes opposed to each other at a predetermined spaced interval, and in the first and second non-display regions with respect to the second direction adjacent to the display region, one end of the first sustain discharge electrode is not present within the first non-display region and is present within the display region on the side of a boundary between the display region and the first non-display region.

A second aspect of the invention is directed to the substrate of the first aspect, wherein the other end of the first sustain discharge electrode is present within the second non-display region, one end of the second sustain discharge electrode is not present within the second non-display region and is present within the display region on the side of a boundary between the second non-display region and the display region, and the other end of the second sustain discharge electrode is present within the first non-display region.

A third aspect of the invention is directed to the substrate of the second aspect, wherein the one end of the first sustain discharge electrode is present at a portion of the display region corresponding to one outermost barrier rib defining the boundary between the first non-display region and the display region in the plurality of barrier ribs, and the one end of the second sustain discharge electrode is present at a portion of the display region corresponding to the other outermost barrier rib defining the boundary between the second non-display region and the display region in the plurality of barrier ribs.

A fourth aspect of the invention is directed to the substrate of the second aspect wherein the one end of the first sustain discharge electrode is present at a portion of the display region corresponding to one outermost lane adjacent to the boundary between the first non-display region and the display region in a group of lanes, and the one end of the second sustain discharge electrode is present at a portion of the display region corresponding to the other outermost lane adjacent to the boundary between the second non-display region and the display region in the group of lanes.

A fifth aspect of the invention is directed to the substrate of the third aspect wherein the first sustain discharge electrode comprises a first bus electrode, the second sustain discharge electrode comprises a second bus electrode, one end of the first bus electrode of the first sustain discharge electrode is present at a portion of the display region corresponding to one outermost lane adjacent to the boundary between the first non-display region and the display region, one end of the second bus electrode of the second sustain discharge electrode is present at a portion of the display region corresponding to the other outermost lane adjacent to the boundary between the second non-display region and the display region, the one end of the first bus electrode of the first sustain discharge electrode has a first pattern width greater than a pattern width of portions other than the mentioned one end of the first bus electrode with respect to the first direction, and the one end of the second bus electrode of the second sustain discharge electrode has a second pattern width greater than a pattern width of portions other than the mentioned one end of the second bus electrode with respect to the first direction.

A sixth aspect of the invention is directed to the substrate of the fifth aspect, wherein in the first bus electrode of the first sustain discharge electrode, a pattern width of a portion present in the display region corresponding to the other outermost lane is partially smaller than a pattern width of a portion present in the display region corresponding to a lane adjacent to the other outermost lane, and in the second bus electrode of the second sustain discharge electrode, a pattern width of a portion present in the display region corresponding to the one outermost lane is partially smaller than a pattern width of a portion present in the display region corresponding to a lane adjacent to the one outermost lane.

A seventh aspect of the invention is directed to the substrate of the fifth aspect, further comprising: a plurality of insulating patterns being formed either on the substrate body or in the dielectric layer and extending between adjacent sustain discharge electrode pairs in the second direction, wherein in each of the plurality of insulating patterns, a pattern width in the first direction of a first portion present in the display region corresponding to the one outermost lane and a pattern width in the first direction of a second portion present in the display region corresponding to the other outermost lane are both partially thinner than a pattern width of portions other than the first and second portions of the insulating pattern with respect to the first direction.

An eighth aspect of the invention is directed to a surface discharge AC type plasma display panel comprising: a first panel being the substrate of the first aspect; and a second panel attached at its peripheral part to the first panel.

A ninth aspect of the invention is directed to a surface discharge AC type plasma display device comprising: the surface discharge AC type plasma display panel of the eighth aspect; and a drive unit configured to drive the surface discharge AC type plasma display panel.

A tenth aspect of the invention is directed to a substrate being used for a surface discharge AC type plasma display panel wherein a discharge cell is formed by each intersecting point of each lane and each scanning line, the each lane being partitioned by barrier ribs adjacent to each other within a plurality of barrier ribs provided to extend in a first direction and being associated with drive of an address electrode corresponding to the barrier ribs adjacent to each other within a plurality of address electrodes provided to extend in the first direction, and the each scanning line being defined by an arbitrary sustain discharge electrode pair within a plurality of sustain discharge electrode pairs provided to extend in a second direction orthogonal to the first direction and a display region defines the discharge cell aligned in matrix, the substrate comprising: a substrate body; the plurality of sustain discharge electrode pairs formed on the substrate body; a dielectric layer formed on the substrate body and covering the plurality of sustain discharge electrode pairs; and a cathode film formed on the dielectric layer, wherein each of the plurality of sustain discharge electrode pairs comprises first and second sustain discharge electrodes opposed to each other at a predetermined spaced interval, first and second non-display regions are adjacent to the display region with respect to the second direction, one end of the first sustain discharge electrode is disposed at a portion of the first non-display region which is located in the vicinity of a boundary between the display region and the first non-display region, an extension portion of the first sustain discharge electrode extending in the second direction from the boundary to the one end is smaller in area than a portion of the first sustain discharge electrode at the discharge cell within the display region, and the second sustain discharge electrode extends in the second direction within the first non-display region and is opposed to the extension portion of the first sustain discharge electrode.

An eleventh aspect of the invention is directed to the substrate of the tenth aspect, wherein the extension portion of the first sustain discharge electrode has a length of 200 μm or less in the second direction.

A twelfth aspect of the invention is directed to the substrate of the tenth aspect, wherein a portion of the second sustain discharge electrode which is opposed to the extension portion of the first sustain discharge electrode in the first non-display region comprises a concave portion recessed in the first direction.

A thirteenth aspect of the invention is directed to the substrate of the tenth aspect, wherein one end of the second sustain discharge electrode is disposed at a portion of the second non-display region which is located in the vicinity of a boundary between the display region and the second non-display region, an extension portion of the second sustain discharge electrode extending in the second direction from the boundary between the display region and the second non-display region to the one end of the second sustain discharge electrode is smaller in area than a portion of the second sustain discharge electrode at the discharge cell within the display region, and the first sustain discharge electrode extends in the second direction within the second non-display region and is opposed to the extension portion of the second sustain discharge electrode.

A fourteenth aspect of the invention is directed to a surface discharge AC type plasma display panel comprising: a first panel being the substrate of the tenth aspect; and a second panel attached at its peripheral part to the first panel.

A fifteenth aspect of the invention is directed to a surface discharge AC type plasma display device comprising: the surface discharge AC type plasma display panel of fourteenth aspect; and a drive unit configured to drive the surface discharge AC type plasma display panel.

A sixteenth aspect of the invention is directed to a substrate being used for a surface discharge AC type plasma display panel wherein a discharge cell is formed by each intersecting point of each lane and each scanning line, the each lane being partitioned by barrier ribs adjacent to each other within a plurality of barrier ribs provided to extend in a first direction and being associated with drive of an address electrode corresponding to the barrier ribs adjacent to each other within a plurality of address electrodes provided to extend in the first direction, and the each scanning line being defined by an arbitrary sustain discharge electrode pair within a plurality of sustain discharge electrode pairs provided to extend in a second direction orthogonal to the first direction, and a display region defines the discharge cell aligned in matrix, the substrate comprising; a substrate body; the plurality of sustain discharge electrode pairs formed on the substrate body; a dielectric layer formed on the substrate body and covering the plurality of sustain discharge electrode pairs; and a cathode film formed on the dielectric layer, wherein each of the plurality of sustain discharge electrode pairs comprises first and second sustain discharge electrodes opposed to each other at a predetermined spaced interval, first and second non-display regions are adjacent to the display region with respect to the second direction, a plurality of first discharge spaces extending in the first direction and being aligned in the second direction are disposed in the display region, the first non-display region comprising: a first region adjacent to the display region with respect to the second direction; and a second region adjacent to the first region with respect to the second direction, wherein a plurality of second discharge spaces extending in the first direction and being aligned in the second direction are disposed in the first region, one end of the first sustain discharge electrode is disposed within the first region, the second sustain discharge electrode extends in the second direction within the first region and the second region, a space in each of the plurality of second discharge spaces which is opposed to a portion of the first sustain discharge electrode defining a discharge cell of the respective second discharge spaces is smaller than a space in each of the plurality of first discharge spaces which is opposed to a portion of the first sustain discharge electrode defining the discharge cell of the respective first discharge spaces, and a space in each of the plurality of second discharge spaces which is opposed to a portion of the second sustain discharge electrode defining the discharge cell of the respective second discharge spaces is smaller than a space in each of the plurality of first discharge spaces which is opposed to a portion of the second sustain discharge electrode defining the discharge cell of the respective first discharge spaces.

A seventeenth aspect of the invention is directed to the substrate of the sixteenth aspect, wherein each of the plurality of second discharge spaces is smaller in width in the second direction than each of the plurality of first discharge spaces.

An eighteenth first aspect of the invention is directed to the substrate of the sixteenth aspect, the second non-display region comprising: a first region adjacent to the display region with respect to the second direction; and a second region adjacent to the first region of the second non-display region with respect to the second direction, wherein a plurality of third discharge spaces extending in the first direction and being aligned in the second direction are disposed within the first region of the second non-display region, one end of the second sustain discharge electrode is disposed within the first region of the second non-display region, the first sustain discharge electrode extends in the second direction within the first region and the second region of the second non-display region, a space in each of the plurality of third discharge spaces which is opposed to a portion of the second sustain discharge electrode defining a discharge cell within the respective third discharge spaces is smaller than a space in each of the plurality of first discharge spaces which is opposed to a portion of the second sustain discharge electrode defining the discharge cell within the respective first discharge spaces, and a space in each of the plurality of third discharge spaces which is opposed to a portion of the first sustain discharge electrode defining the discharge cell within the respective third discharge spaces is smaller than a space in each of the plurality of first discharge spaces which is opposed to a portion of the first sustain discharge electrode defining the discharge cell within the respective first discharge spaces.

A nineteenth aspect of the invention is directed to a surface discharge AC type plasma display panel comprising: a first panel being the substrate of the sixteenth aspect; and a second panel attached at its peripheral part to the first panel.

A twentieth aspect of the invention is directed to a surface discharge AC type plasma display device comprising: the surface discharge AC type plasma display panel of the nineteenth aspect; and a drive unit configured to drive the surface discharge AC type plasma display panel.

With the first, eighth or ninth aspect, when the same substrate is used for a PDP, it is able to suppress occurrence of accidental sustain discharge in the first non-display region. This enables to suppress luminous display irregularity in the vicinity of the boundary between the display region and the first non-display region.

With the second, eighth or ninth aspect, when the same substrate is used for a PDP, it is able to suppress occurrence of accidental sustain discharge causing luminous display irregularity in the first and second non-display regions. As a result there is no need for driving the non-display region by dummy address electrodes and for preparing output terminals for driving the dummy address electrodes in addition to a number of data ICs necessary for driving the address electrodes to which image data are outputted. This permits a cost reduction than the conventional techniques using the dummy address electrodes.

With the third, eighth or ninth aspect, when the same substrate is used for a PDP, sustain discharge electrode pairs become uniform patterns in all the lanes within the display region, and luminous property in the outermost lanes can be made substantially the same as that in the lanes located inwardly from the outermost lanes. That is, there is little or no luminous display irregularity in the vicinity of the boundary between the display region and the first and second non-display regions, which can be caused when both of one end of the first and second sustain discharge electrodes are present in the display region.

With the fourth, eighth or ninth aspect, when the same substrate is used for a PDP, luminous display irregularity which occurs in the vicinity of the boundary between the display region and the first or second non-display region, and which can be caused when both of one end of the first and second sustain discharge electrodes are present in the display region, can be made sensorially inconspicuous.

With the fifth, eighth or ninth aspect, when the same substrate is used for a PDP, the surfaces of both the dielectric layer and the cathode film are most greatly swelled at one and the other outermost lanes, and the adjacent barrier ribs to partition the respective outermost lanes are brought into contact with the cathode film away from the greatest swell portions. Thereby, the gap between the barrier rib and cathode film can be reduced to reinforce isolation of discharge between adjacent lanes. In these aspects, the pattern width of one end of the bus electrode is also set to be thicker than other portions. This ensures reliability when probing is performed for the end of the bus electrode in order to check burn-out and short-cut in the process for forming the bus electrode pattern.

With the sixth, seventh, eighth or ninth aspect, when the same substrate is used for a PDP, it is able to further reduce swell of the surface of the dielectric layer in the vicinity of one end of the bus electrode. This permits a further reduction in the gap between the barrier rib and cathode film, thus enabling to more reinforce isolation of discharge between adjacent lanes.

With the tenth to twentieth aspects, when the same substrate is used for a PDP, it is able to weaken the electric field strength which the sustain discharge electrode pair in the non-display region forms in the vicinity of the surface of the cathode film. This enables to suppress occurrence of accidental sustain discharge between sustain discharge electrodes within the non-display region.

It is an object of the present invention to improve quality of display by suppressing occurrence of accidental sustain discharge within the non-display region in a surface discharge AC type PDP, without causing the above-mentioned drawback I (physical limitation) and drawback II (cost increase).

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 9:
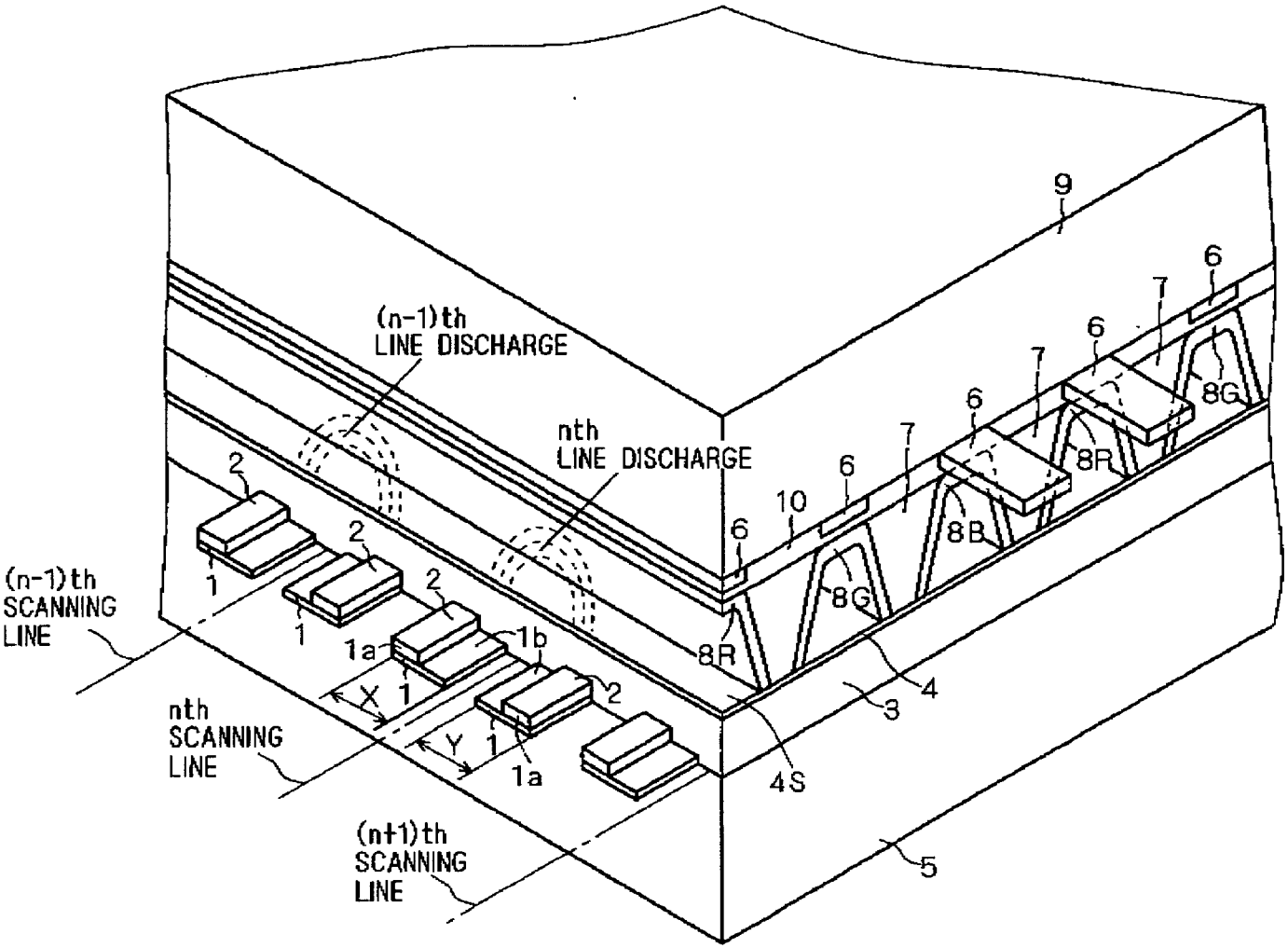
FIG. 9 (PRIOR ART)
FIG. 9 is a perspective view illustrating an example of a discharge cell structure of a conventional surface discharge AC type PDP.

A first preferred embodiment of the present invention is directed to improve the discharge cell structure shown in FIG. 9 described as an example of conventional techniques. That is, the structure of a discharge cell located in the display region as previously described is basically similar to that shown in FIG. 9, however, the structure or a substrate or a front panel in the non-display region is different from that shown in FIG. 9. In the following description, the same reference numerals will be used as in FIG. 9 for similar parts, and the concept or definition of the "display region" and "non-display region" is identical with that in the conventional techniques. Therefore, a front panel (first substrate) of a PDP according to the first preferred embodiment has (i) a front glass substrate 5 that is the (first) substrate body; (ii) plural sustain discharge electrode pairs which extend in a second direction D2 orthogonal to a first direction D1 (see FIG. 1 to be described later) and define in pairs their respective scanning lines (Each pair consists of first and second sustain discharge electrodes X and Y opposed to each other at a predetermined spaced interval, and the sustain discharge electrodes X and Y are each made up of a transparent electrode 1 and a bus electrode 2); (iii) a dielectric layer 3 formed on the front glass substrate 5 so as to cover the plural sustain discharge electrode pairs (X, Y); and (iv) a cathode film 4 formed on the dielectric layer 3. A rear panel (second substrate) has a rear glass substrate 9 that is the (second) substrate body, address electrode 6 and barrier rib 7, each extending in the first direction D1, and an over-glaze layer 10.

Figure 10:
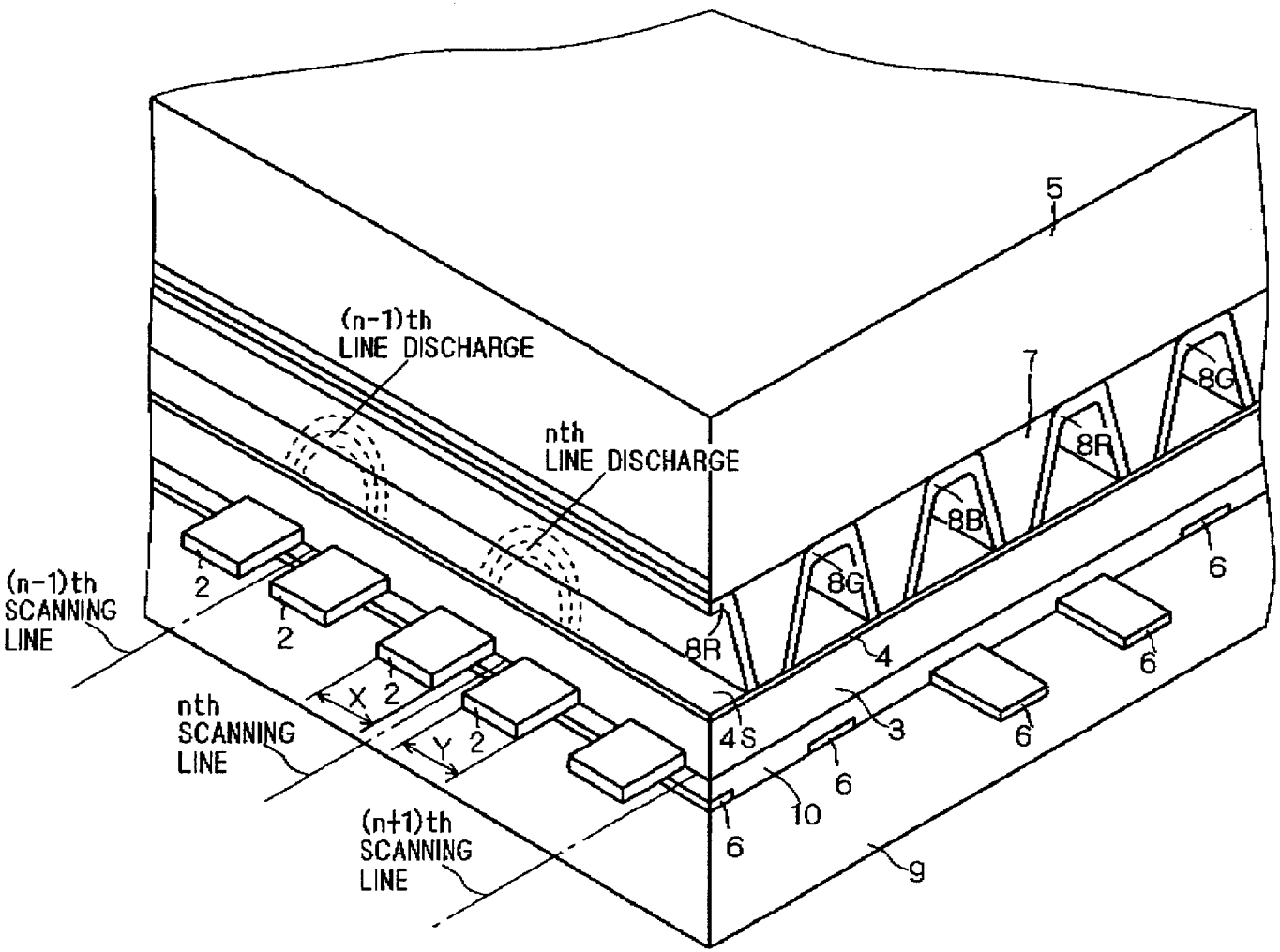
FIG. 10 (PRIOR ART)
FIG. 10 is a perspective view illustrating another example of a discharge cell structure of a conventional surface discharge AC type PDP.
Figure 11:
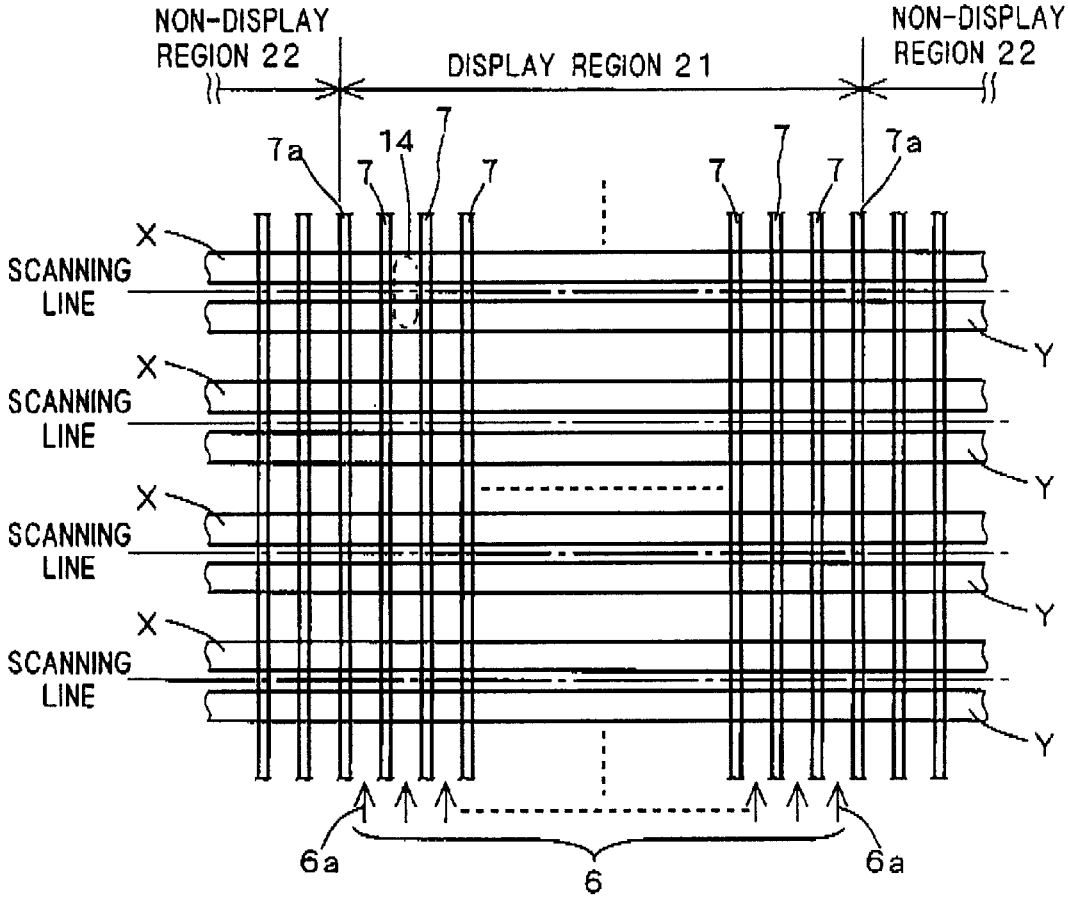
FIG. 11 (PRIOR ART)
FIG. 11 is a plan view of a construction in the vicinity of the boundary between a display region and a non-display region in a conventional surface discharge AC type PDP.

The discharge cell structure shown in FIG. 10 is the same as that shown in FIG. 9, except for the points that the substrate body of a substrate or a panel having plural sustain discharge electrode pairs is a rear glass substrate in place of a front glass substrate, and that no transparent electrode is present in every sustain discharge electrode. Therefore, the characteristic configuration of this embodiment can be applied to the discharge cell structure of FIG. 10. In this case, the discharge cell located in the display region has basically the structure shown in FIG. 10, and the construction in the non-display region of the rear panel or substrate is markedly different from that shown in FIG. 10.

Figure 1:
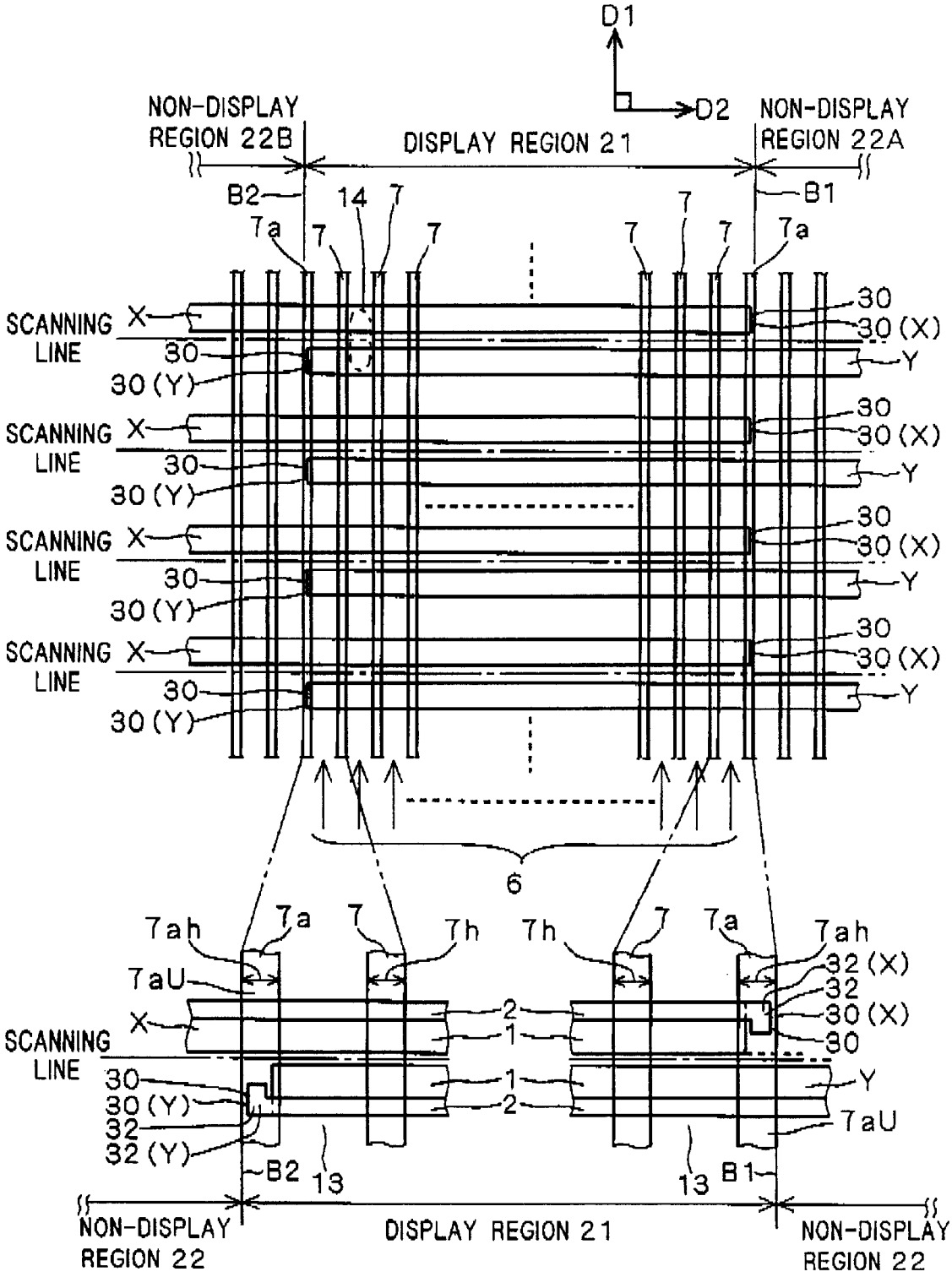
FIG. 1 is a plan view of a construction in the vicinity of the boundary between a display region and a non-display region in a surface discharge AC type PDP according to a first preferred embodiment of the invention.

Referring to FIG. 9 and FIG. 1, the characteristic construction of a surface discharge AC type PDP according to the first preferred embodiment will be described.

FIG. 1 is a plan view schematically illustrating a construction in the respective boundaries (first and second boundaries B1 and B2) between a display region 21 and each of non-display regions 22 adjacent to the region 21 with respect to the second direction D2 (i.e., first and second non-display regions 22A and 2213), when a surface discharge AC type PDP of the first preferred embodiment is viewed from its display surface. In FIG. 1 there are shown a pattern shape of the sustain discharge electrode pair (X, Y) extending in the second direction D2, pattern shapes of the transparent electrode 1 and bus electrode 2 constituting each of the first and second sustain discharge electrodes X and Y, and a pattern shape of a barrier rib 7 extending in the first direction D1. As to each address electrode 6 extending in the first direction D1, FIG. 1 merely illustrates schematically which lane in a group of lanes defined or partitioned by being sandwiched between adjacent barrier ribs 7 is driven by the address electrode 6. An outline of the transparent electrode 1 overlapping with the pattern of the bus electrode 2 is indicated in a broken line.

Figure 12:
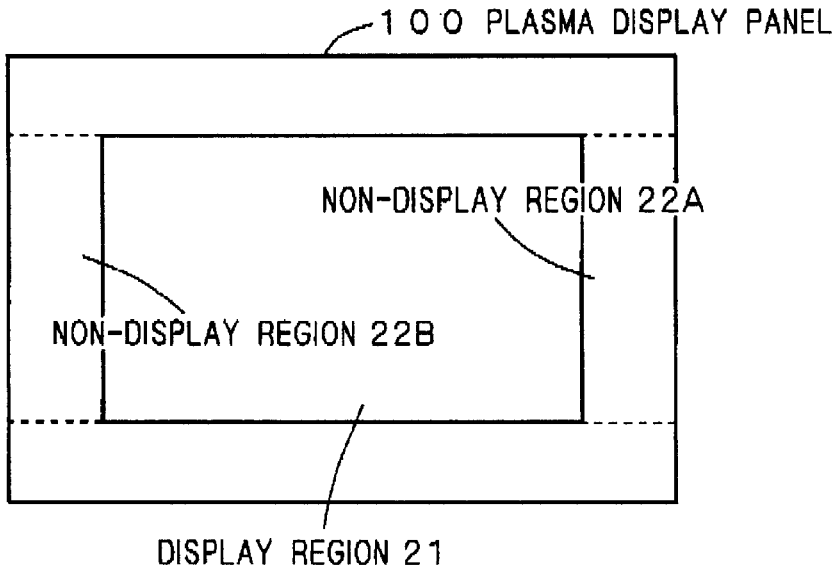
FIG. 12 is a plan view schematically illustrating a display region and a non-display region in a surface discharge AC type PDP.

As shown in FIG. 1, plural barrier ribs 7 extend in the first direction D1, and, in a group of lanes consisting of lanes defined by the adjacent ribs 7, lanes located in the display region 21 are associated with drive of address electrodes 6 corresponding to these lanes in plural address electrodes 6. Plural sustain discharge electrode pairs (X, Y) which are made up of first and second sustain discharge electrodes X and Y, each defining a scanning line, extend in the second direction D2. A discharge cell 14 is formed at the point where an arbitrary scanning line intersects an arbitrary lane associated with drive of the address electrode 6. The display region 21 are formed by aligning such a discharge cell 14 in matrix. With respect to the second direction D2, the first non-display region 22A is adjacent via the first boundary B1 to the right side of the display region 21, and the second non-display region 22B is adjacent via the second boundary B2 to the left side of the display region 21. The overall construction of the non-display region made up of the first and second non-display regions 22A and 22B is shown in FIG. 12.

The characteristic features of the construction of FIG. 1 are as follows. That is, the first and second sustain discharge electrodes X and Y constituting each of the sustain discharge electrode pairs form, on the opposite sides in the direction D2 in which these electrodes extend, one end or first ends 30 (X) and 30 (Y) within the display region 21 in the vicinity of first and second boundaries B1 and B2, respectively. More specifically, in the first non-display region 22A, one end 30 (X) of the first sustain discharge electrode X is not present and only the other end or a second end (not shown) of the second sustain discharge electrode Y is present. Therefore, no sustain discharge electrode pair is present. Similarly, in the second non-display region 22B, one end or a first end 30 (Y) of the second sustain discharge electrode Y is not present and only the other end or a second end (not shown) of the first sustain discharge electrode X is present. Therefore, no sustain discharge electrode pair is present. Therefore, both of the first and second non-display regions 22A and 22B cause no accidental sustain discharge between the sustain discharge electrode pair. Thus, in this PDP, there is no necessity of driving the non-display region 22 by dummy address electrodes as in the second conventional technique. This permits a cost reduction than the method of the second conventional technique in which it is necessary to provide the output terminals for driving dummy address electrodes in addition to data ICs necessary for driving the address electrodes 6 to which an image data is outputted.

As to connection between the first or second sustain discharge electrode X or Y, and an external terminal for driving (not shown), it may be such that the first and second sustain discharge electrodes X and Y are connected to the external terminals for driving on the opposite side of its one end 30 (X) or 30 (Y) in the direction of their extension, namely at the other end (not shown). Thereby, a desired electrical wiring can be easily provided to each of the first and second sustain discharge electrodes X and Y.

In the PDP of the first preferred embodiment, one end 30 (X) of the first sustain discharge electrode X and one end 30 (Y) of the second sustain discharge electrode Y are disposed in the display region 21 on the side of the first boundary B1 and the display region 21 on the side of the second boundary B2, respectively. Specifically, one end 30 (X) of the first sustain discharge electrode X is present at the portion of the display region 21 which corresponds to or faces one outermost barrier rib 7*a* defining the first boundary B1. Similarly, one end 30 (Y) of the second sustain discharge electrode Y is present at the portion of the display region 21 which corresponds to or faces the other outermost barrier rib 7*a* defining the second boundary B2. That is, as shown in FIG. 1, one ends 30 (X) and 30 (Y) of the first and second sustain discharge electrodes X and Y (these ends are also generally called an "end 30"), when the PDP of this embodiment is viewed from above in FIG. 1, are disposed at position 7*a*U overlapping with one outermost and the other outermost barrier ribs 7*a* to define the first and second boundaries B1 and B2, respectively, in plural barrier ribs 7 located in the display region 21. Thereby, all the lanes in the display region 21 including the outermost lanes 13 have plural sustain discharge electrode pairs (X, Y) having a uniform pattern (each of the electrodes X and Y has a transparent electrode 1 and a bus electrode 2). Accordingly, there is no possibility that the distribution of luminous characteristic of the discharge cell 14 in the display region 21 is of different at the outermost lanes 13 of the display region 21. Further, with the arrangement that in the display region 21, the corresponding pattern width 7*ah* of the outermost barrier ribs 7*a* is increased than a pattern width 7*h* of other barrier ribs 7, while holding the width of the outermost lanes 13, it is able to increase the margin of position and shape of the end 30 of the first and second sustain discharge electrodes X and Y and those of the end 32 of the bus electrode 2 to be described later.

In the PDP of this embodiment shown in FIG. 1 one end 30 in the display region of the first and second sustain discharge electrodes X and Y is formed by one end (first end) 32 of the bus electrode 2 constituting these electrodes X and Y. That is, one end of the transparent electrode 1 of the first and second sustain discharge electrodes X and Y is also present in the display region 21 corresponding to or facing one or the other outermost barrier rib 7*a* and is not present in one or the other outermost lane 13, whereas one end 32 of the bus electrode 2 projects to the corresponding boundary B1 or B2 from the mentioned one end of the transparent electrode 1. Such construction is realized in the following manner: in order that one end 32 of the bus electrode 2 is in L-shape, the pattern width in the first direction D1 of the bus electrode 2 is set at one end 32 of the bus electrode 2 so as to be thicker than that of other portions. At immediately below this end 32, no transparent electrode 1 is present, and the mentioned one end 32 is formed directly on the surface of the front glass substrate 5. The reason for this is as follows. That is, in order to ensure probing reliability of an inspection prober that is usually used when checking bum-out and short-cut in the process for forming the pattern of the bus electrode 2, the probing point of the bus electrode 2 calls for a wider pattern width. Also in the PDP of this embodiment, in order to make possible to realize a similar check of bum-out and the like at the time of the process of the pattern formation of the bus electrode 2, one end 32 of the bus electrode 2 of the PDP is required to be set as a probing point. More specifically, it is said to be desirable that in order to minimize the shading of luminescence of the phosphor 8 within the discharge cell, the width of the bus electrode 2 used for the discharge cell structure of FIG. 9 is finished finely within the range that allows for an increase in the lead resistance value and in pattern defect incidence rate. This conflicts with improvement of reliability of probing, however, both are compatible by setting such that the width of the bus electrode 2 is locally wider at one end 32 of the bus electrode 2 for which probing is necessary.

Since a pinpoint force from the prober is exerted at the probing point of the bus electrode 2, it is required to enhance the adhesion of the probing point to the underlying component. When compared the adhesion in the case that the underlying component of the bus electrode 2 is the transparent electrode 1 or the surface of the front substrate 5, the latter is usually stronger (This has been pointed out in Japanese Patent Unexamined Publication No. 5-114362). Therefore, in the PDP of this embodiment, the pattern of the transparent electrode 1 corresponding to one end 32 of the bus electrode 2 which corresponds to the probing point, as shown by the outline in the broken line in FIG. 1, is partially removed as previously described, thereby increasing the adhesion of one end portion of the bus electrode 2 to the underlying substrate. This construction for increasing the adhesion to the underlying substrate is applicable to the following second preferred embodiment and all of its modifications.

Unless the adhesion is considered, it may be so constructed that the pattern width of one end 32 of the bus electrode 2 is set so as to be greater than that of other portions, and the position of one end 32 of the bus electrode 2 is matched with the position of one end of the transparent electrode 1, so that both ends form one end 30 of the respective sustain discharge electrodes X and Y.

First Modification of First Preferred Embodiment

In FIG. 1, one ends 30 (X) and 30 (Y) of the first and second sustain discharge electrodes X and Y are not present in the corresponding fist and second non-display regions 22A and 22B, respectively. Such construction may be adopted only for one end 30 (X) or 30 (Y).

For instance, as a modification of the construction of FIG. 1, it can be considered such that only one end 30 (X) of the first sustain discharge electrode X is present at the portion of the display region 21 which corresponds to one outermost barrier rib 7*a* adjacent to the first boundary B1, whereas, like the conventional technique, one end 30 (Y) of the second sustain discharge electrode Y is present in the second non-display region 22B (or it may be vice versa). Alternatively, it may be constructed such that, while adopting this modification, the other end (not shown) of the second sustain discharge electrode Y is not present in the first non-display region 22A, that is, the other end of the second sustain discharge electrode Y is present at the portion of the display region 21 which corresponds to one outermost barrier rib 7*a* adjacent to the first boundary B1, so that it faces one end 30 (X) of the first sustain discharge electrode X.

According to this modification, only in the first non-display region 22A shown in FIG. 1, no sustain discharge electrode pair (X, Y) is present thereby to prevent accidental sustain discharge between sustain discharge electrodes in the first non-display region 22A. In contrast, only in the second non-display region 22B, accidental sustain discharge between sustain discharge electrodes can be prevented with the reversed construction of this modification, that is, with the construction that either only one end 30 (Y) of the second sustain discharge electrode Y is not present in the second non-display region 22B, or this end 30 (Y) and the other end of the first sustain discharge electrode X are not present in the second non-display region 22B, whereas one ends 30 (X) of the first sustain discharge electrode X is present in the first non-display region 22A.

Second Modification of First Preferred Embodiment

Figure 22:
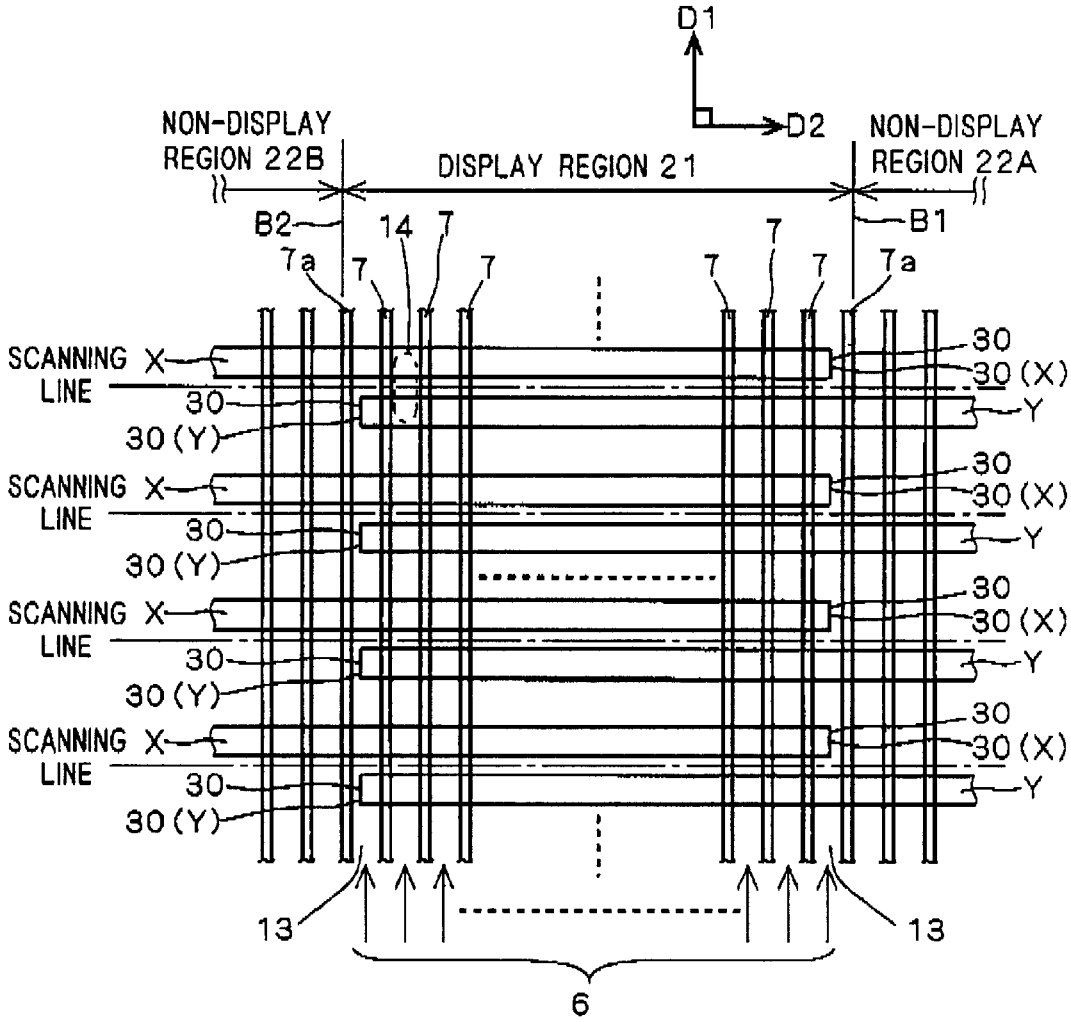
FIG. 22 is a plan view of a construction in the vicinity of the boundary between a display region and a non-display region in a surface discharge AC type PDP according to the second modification of the first preferred embodiment.

Second modification is directed to correct the position of one ends 30 (X) and 30 (Y) of the first and second sustain discharge electrodes X and Y, respectively, in the construction shown in FIG. 1. Its detail will be described hereinafter, In this modification, the first and second sustain discharge electrodes X and Y, constituting a sustain discharge electrode pair, each has its one end, i.e., the first end 30 (X), or 30 (Y), formed on the side opposite from one end of the other electrode so as to overlap the outermost lane 13 adjacent to the first or second boundary B1 or B2. In other words, one end 30 (X) of the first sustain discharge electrode X is present at the portion of the display region 21 which corresponds to or faces one outermost lane 13 adjacent to the first boundary B1 in a group of lanes. On the other hand, one end 30 (Y) of the second sustain discharge electrode Y is present at the portion of the display region 21 which corresponds to or faces the other outermost lane 13 adjacent to the second boundary B2 in the group of lanes (see FIG. 22).

Even with this construction, no sustain discharge electrode pair is present in the first and second non-display regions 22A and 22B. Thus, both of the non-display regions 22A and 22B cause no accidental sustain discharge between a sustain discharge electrode pair.

Although, in this modification, any uniform pattern of the sustain discharge electrode pair cannot be present at one outermost lane 13 and the other outermost lane 13, such disadvantage merely appears on these outermost lanes of the display region 21. Therefore, luminous display irregularity caused by the presence of one ends 30 (X) and 30 (Y) having the above-mentioned arrangement can be made sensorially inconspicuous.

Third Modification of First Preferred Embodiment

Although, in the first preferred embodiment, the sustain discharge electrodes X and Y are defined as "first sustain discharge electrode" and "second sustain discharge electrode", respectively, these electrodes X and Y may be defined as "second sustain discharge electrode" and "first sustain discharge electrode", respectively.

Also, one region 22A of the non-display region 22 and the other region 22B may be called "second non-display region" and "first non-display region", respectively.

Supplementary Note: A surface discharge AC type plasma display device such as a wall-mounted TV can be formed by disposing, in a predetermined casing, a PDP as described in the first preferred embodiment and its first to third modifications, a driver for driving the PDP, etc. This is true for PDPs according to the following second to forth preferred embodiments or their modifications.

Figure 23:
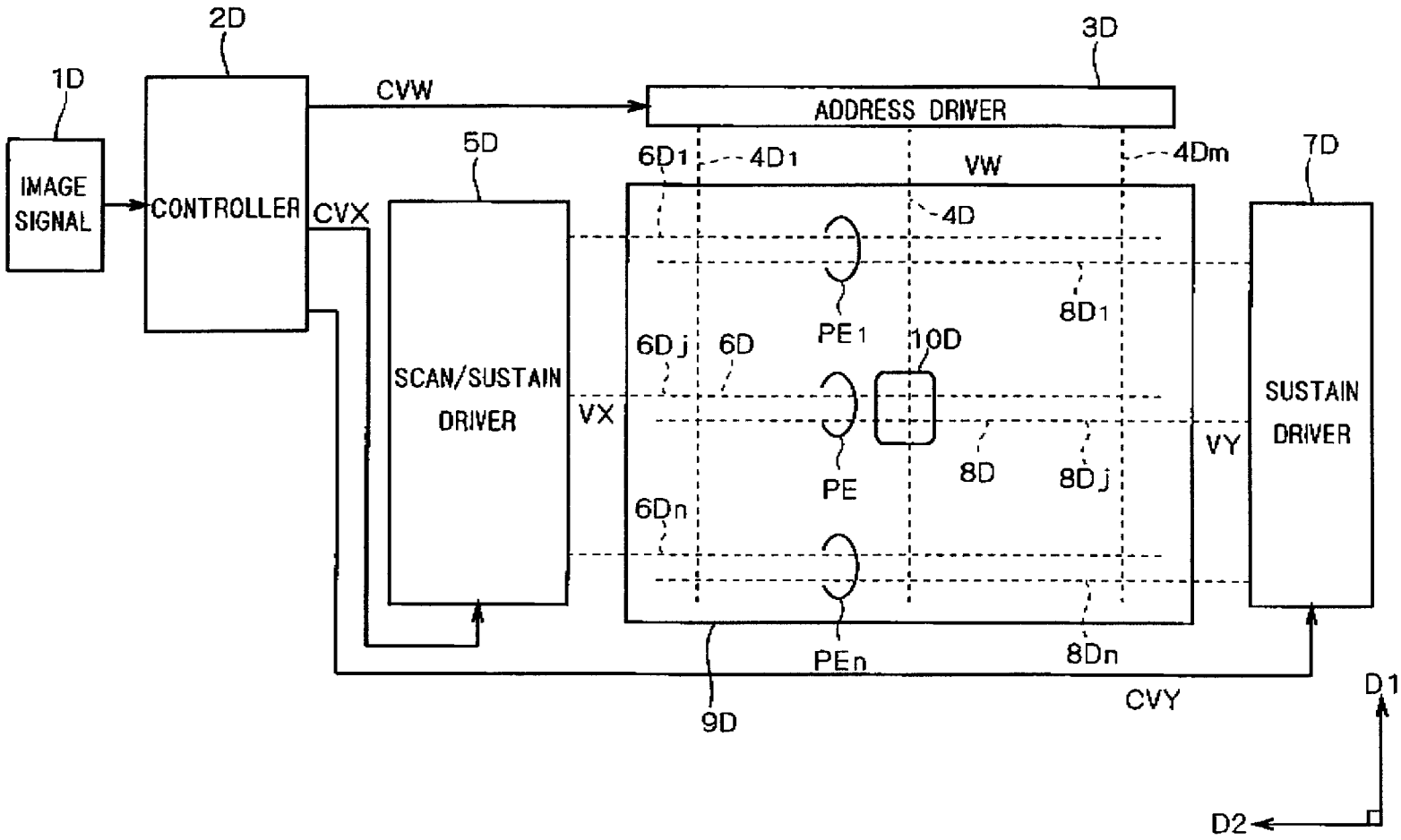
FIG. 23 is a block diagram schematically illustrating a construction of a surface discharge AC type plasma display device according to the invention.
Figures 24A, 24B, 24C:
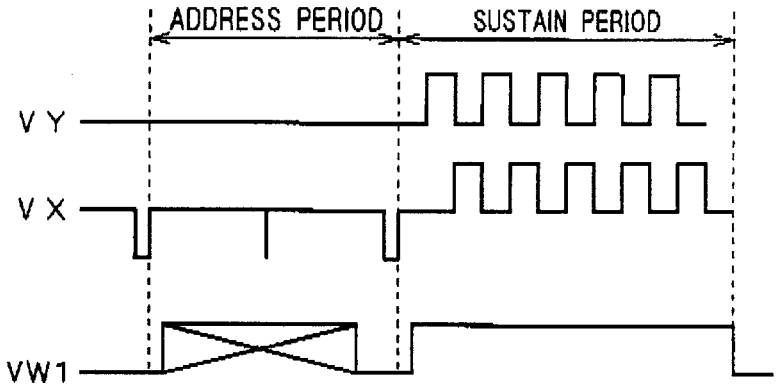
FIGS. 24A, 24B and 24C are timing charts of a drive signal waveform in a certain subfield.

FIG. 23 is a block diagram illustrating a construction of a surface discharge AC type plasma display device. This device comprises a PDP 9D and a drive unit. The drive unit comprises drivers 3D, 5D and 7D and a controller 2D. In FIG. 23, reference 4D denotes m pieces of address electrodes, reference 6D denotes n pieces of sustain discharge electrodes X, reference 8D denotes n pieces of sustain discharge electrodes Y, reference PE denotes n pieces of sustain discharge electrode pairs, and references CVW, CVX and CVY denote first, second and third control signals, respectively. Consider now that the period of displaying one picture of one frame (i.e., one field) is regarded as one which divides it into a predetermined number of subfields to realize gradation representation. In this case, the waveform of each drive signal (pulse) in a subfield is as shown in FIGS. 24A, 24B and 24C. Such drive system is well known.

Second Preferred Embodiment

In the first preferred embodiment, one end of the bus electrode (i.e., a first bus electrode) of the first sustain discharge electrode which is formed wider, and one end of the bus electrode (i.e., a second bus electrode) of the second sustain discharge electrode which is formed wider are disposed in such a range as to overlap one outermost rib and the other outermost rib in the display region, respectively. This construction, however, causes a new problem to be described later. To avoid this, in a second preferred embodiment, one end of each bus electrode of the first and second sustain discharge electrodes is disposed at such a position as to overlap the corresponding outermost lane of the display region 21, thereby enhancing isolation of discharge. Hereinbelow, the second preferred embodiment will be described as an improvement of the construction described with reference to FIG. 1. Therefore, the same reference numerals are used as in FIG. 1 for similar parts in this embodiment.

Figure 2:
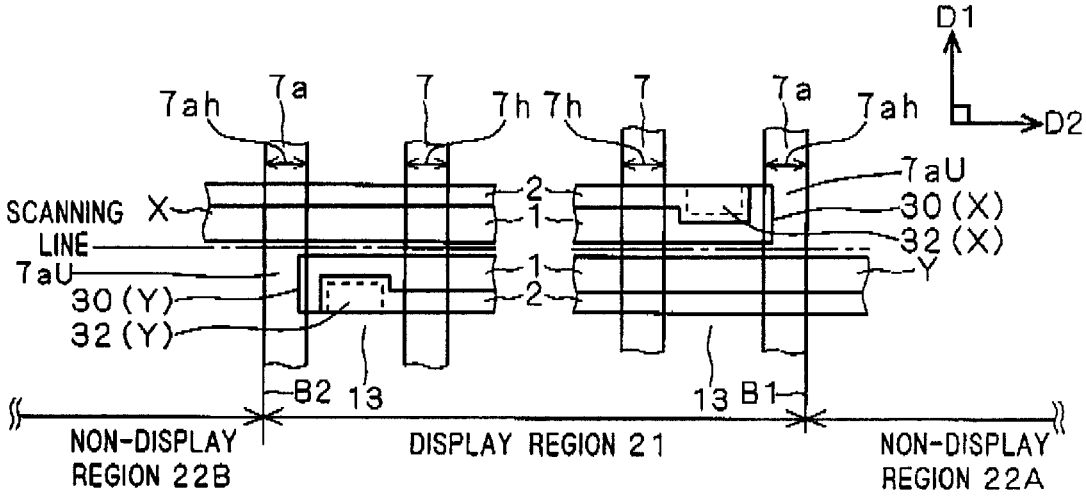
FIG. 2 is a plan view of a construction in the vicinity of the boundary between a display region and a non-display region in a surface discharge AC type PDP according to a second preferred embodiment of the invention.

FIG. 2 is a plan view in an enlarged view illustrating schematically a construction of one sustain discharge electrode pair in the vicinity of the boundaries between a display region 21 and a non-display region 22 (i.e., first and second boundaries B1 and B2) in a surface discharge AC type PDP according to the second preferred embodiment. Each of first and second sustain discharge electrodes X and Y constituting this electrode pair, comprises a transparent electrode 1 such as of ITO film, and a bus electrode 2 of which main component is metal. Here, one ends 32 (X) and 32 (Y) of the bus electrodes 2 respectively located on the side of one ends 30 (X) and 30 (Y) of these electrodes X and Y, are disposed at such a position as to overlap the corresponding one outermost lane 13 and the other outermost lane 13, respectively. That is, one end 32 (X) of the first bus electrode 2 of the first sustain discharge electrode X is present at a portion of the display region 21 which corresponds to one outermost lane 13 adjacent to the first boundary B1 between the first non-display region 22A and display region 21. On the other hand, one end 32 (Y) of the second bus electrode 2 of the second sustain discharge electrode Y is present at a portion of the display region 21 which corresponds to the other outermost lane 13 adjacent to the second boundary B2 between the second non-display region 22B and display region 21. Like the construction of FIG. 1, one ends 30 (X) and 30 (Y) of the electrodes X and Y are present in the display region 21 corresponding to one outermost barrier rib 7*a* defining the first boundary B1 and the other outermost barrier rib 7*a* defining the second boundary B2, respectively, and both one end 30 (X) and one end 30 (Y) correspond to one end of the transparent electrode 1. The reason why one ends 32 (X) and 32 (Y) of the bus electrodes 2 are disposed in this fashion is for preventing the following disadvantage.

That is, when one end 32 of the bus electrode 2 which is formed wider is disposed in such a range as to overlap the corresponding outermost barrier rib 7*a* in the display region 21, as in the construction of FIG. 1, a surface 3S of the dielectric layer 3 swells locally at the point where such one end 32 is present, as described later. As a result, there is probability that a large gap occurs locally between the cathode film 4 and barrier rib 7 in the display region 21 and the large gap thus induces disadvantageous display. Therefore, with the construction of the second preferred embodiment in which one ends 32 (X) and 32 (Y), each being made wider, of the bus electrode 2 of the first and second sustain discharge electrodes X and Y, respectively, are disposed at such a position as to overlap the corresponding outermost lane 13 in the display region 21, it is able to obtain the relative positioning that the location where swell of the surface 3S of the dielectric layer 3 is the largest occurs between one or the other outermost barrier rib 7*a* defining the outermost lane 13, and the barrier rib 7 adjacent to that barrier rib 7*a* on the side of the display region 21. That is, it is avoidable that the barrier rib 7*a* makes contact with the greatest swell location of the surface 3S of the dielectric layer 3, thereby minimizing the gap as described.

The transparent electrode 1 is partially absent at the portion immediately below each of one end 32 (X) and one end 32 (Y). This is the same as the construction of FIG. 1.

There is the following problem by arranging so that the ends 32 (X) and 32 (Y) each having a greater width in the bus electrode 2 of the first and second sustain discharge electrodes X and Y are disposed at such a position as to overlap the corresponding outermost lane 13 of the display region 21, as shown in FIG. 2. That is, this arrangement increases the proportion that luminescence at the discharge cell 14 associated with each outermost lane 13 is shaded by the corresponding one end 32 (X) or 32 (Y) of the bus electrode 2. As a result, luminous display at the respective outermost lanes 13 is relatively dark. However, it appears that the locations where such partial shading of luminescence occurs are limited to the outermost lanes 13 of the display region 21, and therefore, luminous display irregularity is usually within sensory tolerance and thus no special problem occurs. In one pixel, phosphors 8 of three colors of R (red), G (green) and B (blue) are usually formed across three lanes adjacent to each other. Therefore, luminous display irregularity at the outermost lanes 13 can be further made sensorially inconspicuous by arranging so that phosphor of G having the highest luminance in the three colors R, G and B is not provided at the respective outermost lanes 13, and phosphor of R or B is provided at the respective outermost lanes 13.

Note that the characteristic feature of the second preferred embodiment shown in FIG. 2 is applicable to the case that discharge cells in the display region, except for those disposed at the outermost lanes, have the construction shown in FIG. 10. In this case, since the first and second sustain discharge electrodes X and Y are both formed only by the bus electrode 2, one end 32 (X) and one end 32 (Y) of the bus electrodes 2, each of which is wider and formed at the display region corresponding to each outermost lane 13, form one end 30 (X) and one end 30 (Y) of the first and second sustain discharge electrodes X and Y, respectively. This is true for the following first and second modifications.

First Modification of Second Preferred Embodiment

With the construction of FIG. 2 in the second preferred embodiment, swell of the surface of both the dielectric layer 3 and cathode film 4 becomes the largest at the respective outermost lanes 13 of the display region 21, and the top of the barrier rib 7 is brought into contact with the surface of the cathode 4 away from this largest swell portion. This enables to prevent occurrence of a large gap between the cathode film 4 and barrier rib 7. Since swell of the surface of the dielectric layer 3 and swell of the surface of the cathode film 4 are reduced from each outermost lane 13 to the inner lanes located inwardly in the display region 21, in FIG. 2, the top of the barrier rib 7*a* and the top of the barrier rib 7 adjacent thereto are both in contact with the inclined surface in the course of swell of the surface of the cathode film 4. Therefore, in the construction of FIG. 2, there still exists a gap between the top of the barrier rib 7 and the surface of the cathode film 4 in the display region 21 located inwardly from that point, Accordingly, a first modification has its object to further improve a local gap between the top of a barrier rib and the surface of the cathode film which can be caused even when the construction of FIG. 2 is adopted. For this, it is contrived to reduce both the amount of swell of the surface of the dielectric layer 3 and the amount of swell of the surface of the cathode film 4, in each outmost lane 13, than that in FIG. 2. Hereinafter, the first modification will be described by referring to drawings, and the same references as in the second preferred embodiment (FIG. 2) are also used for similar parts.

Figure 3:
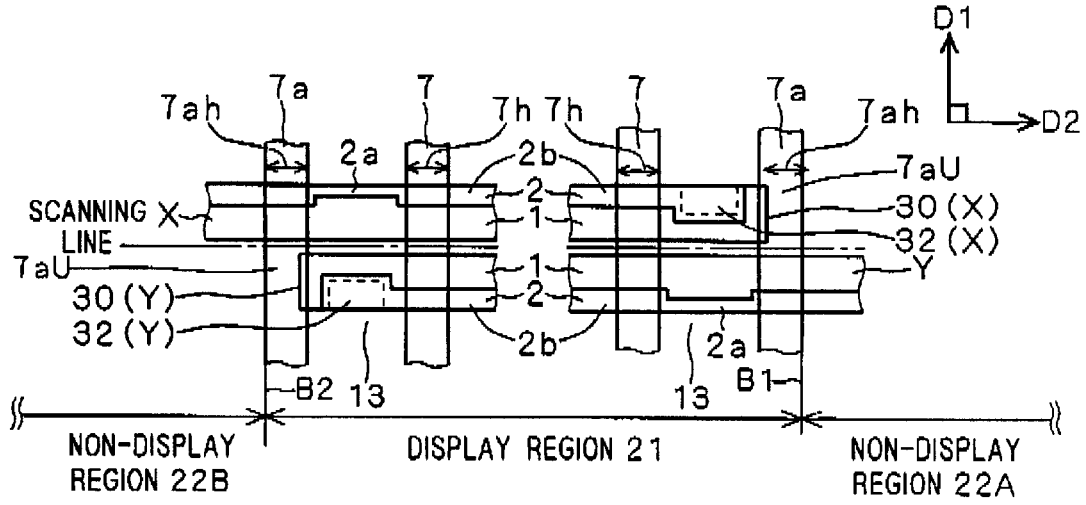
FIG. 3 is a plan view of a construction in the vicinity of the boundary between a display region and a non-display region in a surface discharge AC type PDP according to a first modification of the second preferred embodiment.

FIG. 3 is an enlarged plan view illustrating schematically a construction of one sustain discharge electrode pair in the vicinity of the boundary between the display region 21 and non-display region 22 (i.e., first and second boundaries B1 and B2) in a surface discharge AC type PDP according to the first modification of the second preferred embodiment.

Here, one ends 32 (X) and 32 (Y) of the bus electrodes 2 each located on the side of one ends 30 (X) and 30 (Y) of the electrodes X and Y are disposed at such a position as to overlap the corresponding outermost lane 13 in the display region 21, respectively, and the pattern width of the portion in the outermost lane 13 of the bus electrode 2 forming the sustain discharge electrode X or Y on the side where the other end is not formed at the outermost lane 13, is made partially smaller than other portions, so that the corresponding portion of the bus electrode 2 is formed in a concave state. More specifically, in the bus electrode 2 of the first sustain discharge electrode X, the pattern width in the first direction D1 of a portion 2*a* present in the display region 21 corresponding to the other outermost lane 13 adjacent to the second boundary B2 is set so as to be partially smaller than the pattern width in the first direction D1 of a part 2*b* present in the display region 21 corresponding to the lane adjacent to the other outermost lane 13. Similarly, in the bus electrode 2 of the second sustain discharge electrode Y, the pattern width in the first direction D1 of a portion 2*a* present in the display region 21 corresponding to one outermost lane 13 adjacent to the first boundary B1 is set so as to be partially smaller than the pattern width in the first direction D1 of a part 2*b* present in the display region 21 corresponding to the lane adjacent to one outermost lane 13. Thereby, the following two resulting effects can be obtained.

The first resulting effect is that luminous display irregularity at the outermost lanes 13 can be made further sensorially inconspicuous because the decrement of luminous display intensity caused by shading due to one ends 32 (X) and 32 (Y) of the bus electrodes 2 which are formed wider, is compensated by the amount of light being transmissible the concave portion (notch portion) of the portion 2*a*.

Figure 4:
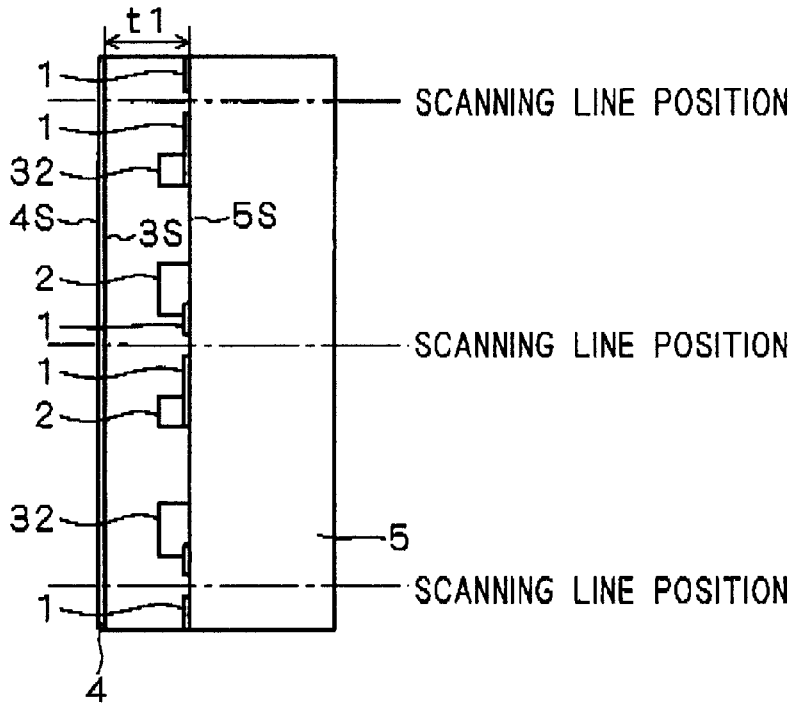
FIG. 4 is a longitudinal section in the vicinity of the end of a bus electrode in a surface discharge AC type PDP according to the second preferred embodiment.
Figure 5:
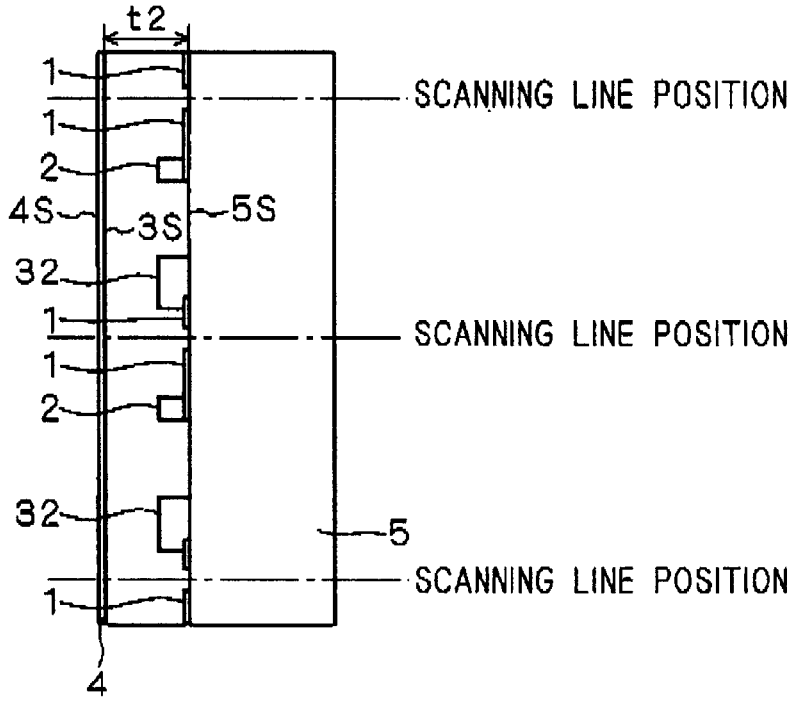
FIG. 5 is a longitudinal section in the vicinity of the end of a bus electrode in a surface discharge AC type PDP according to the first Modification of the second preferred embodiment.
Figure 6:
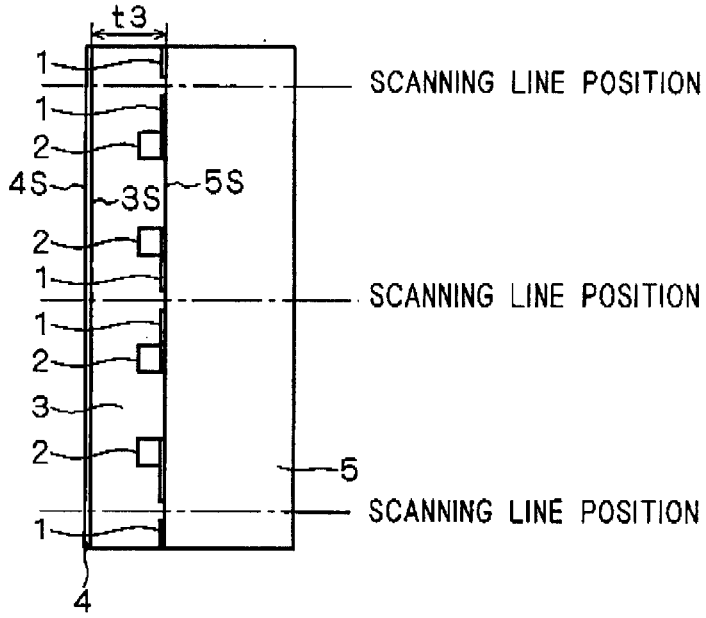
FIG. 6 is a longitudinal section of a display region located inwardly from the end of a bus electrode in a surface discharge AC type PDP according to the first modification of the second preferred embodiment.

The second resulting effect will be described by referring to FIGS. 4 to 6. FIG. 4 is a longitudinal section of a front panel or substrate when one ends 32 of the bus electrodes 2 each having a large width in the second preferred embodiment (FIG. 2) is sectioned by a plane vertical to the direction of extension of the bus electrode 2 (i.e., the second direction D2). FIG. 5 is a longitudinal section of a front panel or substrate when one ends 32 of the bus electrodes 2 each having a large width in the first modification of the second preferred embodiment as shown in FIG. 3, is sectioned by a plane vertical to the direction of extension of the bus electrode 2 (i.e., the second direction D2). FIG. 6 is a longitudinal section of a front panel or substrate when the portion of each bus electrode 2 located inwardly from one end 32 of each bus electrode 2 having a large width in the display region 2 is sectioned by a plane vertical to the direction of extension of the bus electrode 2 (i.e., the second direction D2). In FIGS. 4 to 6, for the sake of convenience, there are illustrated only the transparent electrode 1 and bus electrode 2 which both form each of sustain discharge electrodes X and Y, the dielectric layer 3, the cathode film 4 and the front glass substrate (substrate body) S.

By comparison of FIGS. 4, 5 and 6, it is noted that thickness t1 of the dielectric layer 3 from a surface 5S of the front glass substrate 5, as a reference position in FIG. 4, is greater than thickness t3 of the dielectric layer 3 in FIG. 6. The reason for this is as follows. When the dielectric layer 3 is formed by uniformly applying a low melting point glass paste serving as a raw material of the dielectric layer 3, onto a front glass substrate 5, followed by firing, the cross-sectional area of the dielectric layer 3 (More precisely, the cross-sectional area of the area except for the transparent electrode 1, bus electrode 2 and one end 32 of the bus electrode 2) does not so depend on the state of irregularities (i.e., unevenness) of the surface of the front glass substrate 5 which is a base and thus becomes substantially uniform. Therefore, an increase in the cross-sectional area of the bus electrode 2 as a base, leads to an increase in thickness t1 from the surface 5S of the front glass substrate 5 as a reference position. In other words, in the foregoing second preferred embodiment, the cross-sectional area of the bus electrode 2 at One end 32 of the bus electrode 2 is grater than that of the bus electrode 2 located inwardly from one end 32 in the display region 21. Thus, in the vicinity of one end 32 of the bus electrode 2, the surface 3S of the dielectric layer 3 is locally swelled and the surface 4S of the cathode film 4 is also swelled in response to the swell of the surface 3S. When the top of the corresponding barrier rib of a series of barrier ribs 7 formed on the side of the rear glass substrate 9 abuts the surface 4S of the cathode film 4 being swelled in the vicinity of one end 32, the surface 4S of the cathode film 4 is sharply recessed in the display region 21 adjacent to the vicinity of one end 32 in the direction of extension of the bus electrode 2 (the second direction D2). In response to the recess, the top of the barrier rib 7 cannot maintain contact with the surface 4S of the cathode film 4, resulting in a gap. If this gap is relatively large, isolation of discharge between adjacent lanes will be impaired which, in some cases, leads to sensorially noticeable disadvantage of display. On the other hand, as in this modification, when in the vicinity of one end 32 of the bus electrode 2, the pattern width of the bus electrode 2 to be paired therewith is set to be partially smaller than other portions of the bus electrode 2, as shown in FIG. 5, the cross-sectional area in the vicinity of one end 32 of the bus electrode 2 is smaller than that in FIG. 4. Therefore, thickness t2 of the dielectric layer 3 in each outermost lane 13 (FIG. 3) is reduced thereby to reduce swell of the surface 3S of the dielectric layer 3 in the vicinity of one end 32 of the bus electrode 2. This enables to reduce the gap to be locally caused between the top of the barrier rib 7 and the surface 4S of the cathode film 4, thereby reinforcing isolation of discharge between adjacent lanes.

Second Modification of Second Preferred Embodiment

A second modification of the second preferred embodiment is directed to suppress swell of a surface of a dielectric layer or swell of a surface of a cathode film in each outermost lane when a front panel or a substrate having the construction of FIG. 2 is further provided with plural insulating patterns which are formed on the substrate body or in the dielectric layer and are located between adjacent sustain discharge electrode pairs (X, Y) or between adjacent scanning lines. Hereinafter, description will be made by referring to drawings.

Figure 7:
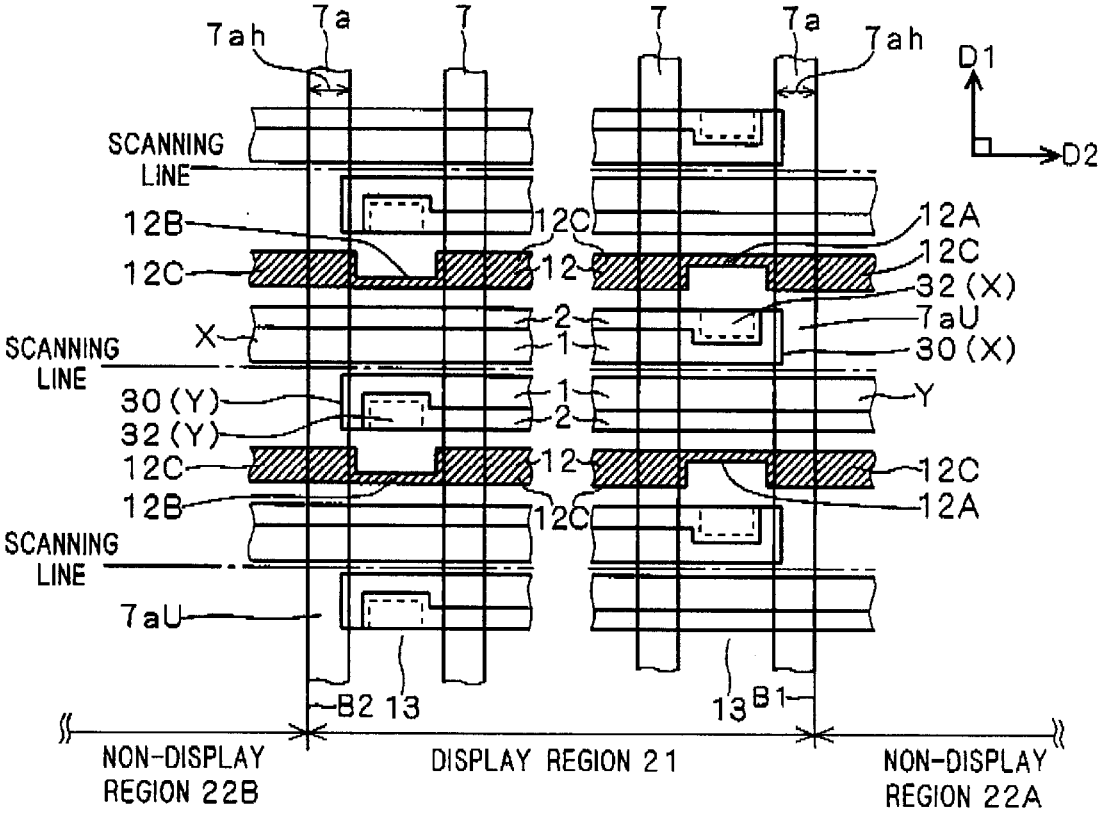
FIG. 7 is a plan view of a construction in the vicinity of the boundary between a display region and a non-display region in a surface discharge AC type PDP according to a second modification of the second preferred embodiment.
Figure 8:
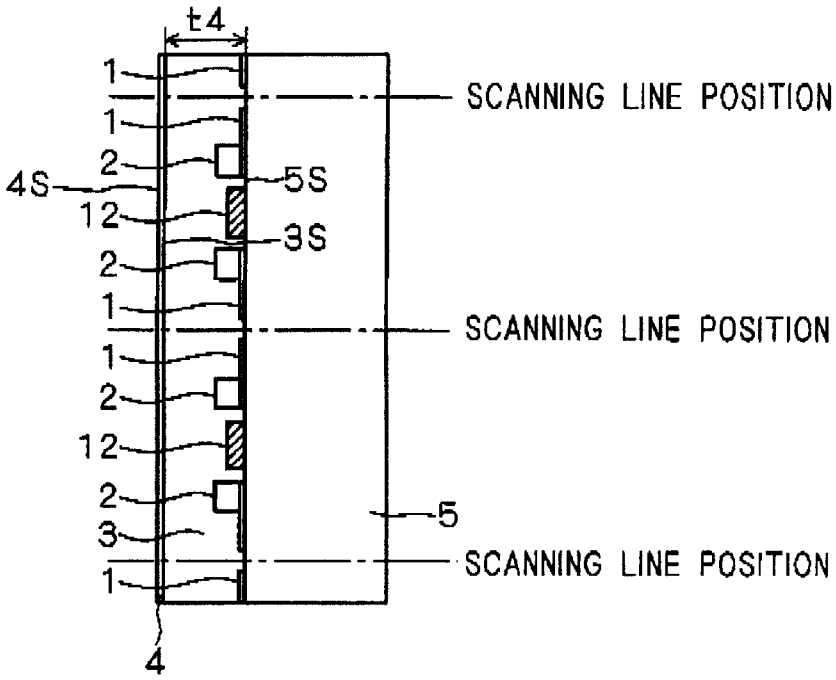
FIG. 8 is a longitudinal section of a display region located inwardly from the end of a bus electrode in a surface discharge AC type PDP according to the second modification of the second preferred embodiment.

FIG. 7 is a plan view in an enlarged view illustrating schematically a construction of sustain discharge electrode pairs in the vicinity of the boundaries between a display region 21 and a non-display region (i.e., first and second boundaries B1 and B2) in a surface discharge AC type PDP according to the second modification of the second preferred embodiment. A dielectric layer 3 of this modification includes an insulating pattern at the boundary of adjacent scanning lines or between adjacent sustain discharge electrode pairs. Especially, this insulating pattern is an insulating pattern 12 of light resistance. FIG. 8 is a longitudinal section illustrating a front panel or substrate when in a display region 21 of the PDP shown in FIG. 7, a portion of a bus electrode 2 locating inwardly from one end 32 (X) or 32 (Y) of the bus electrode 2 is sectioned by a plane vertical to the direction of extension of the bus electrode 2 (i.e., the second direction D2). In FIG. 8, the insulating pattern 12 of light resistance is disposed directly on a surface 5S of a front glass substrate 5. Instead of this, the insulating pattern 12 may be disposed in the dielectric layer 3 within the range of thickness of the dielectric layer 3. The reason why the insulating pattern 12 of light resistance is provided in this modification is as follows. Firstly, a PDP with which exterior light reflection is suppressed to exhibit high quality of display can be obtained by that in the faces of the insulating pattern 12, at least the face on the side of the front glass substrate 5 is formed from a light absorptive material which is usually a material having black color tone. Secondly, it is able to prevent luminescence of a phosphor 8 from being absorbed by the above-mentioned light absorptive material by that the face of the insulating pattern 12 on the side of the rear glass substrate 9 is formed from a light reflective material which is usually a material having white color tone.

In this modification further comprising the construction that the dielectric layer 3 has the insulating pattern 12 of light resistance, each insulating pattern 12 is shaped as a concave in the vicinity of each of wide one ends 32 (X) and 32 (Y) of the bus electrodes 2, thereby to reduce the density of its pattern area, as shown in FIG. 7. More specifically, between the adjacent sustain discharge electrode pairs (X, Y), each of plural insulating patterns 12 extending in the second direction D2 has a first portion 12A present at the display region 21 corresponding to one outermost lane 13, a second portion 12B present at the display region 21 corresponding to the other outermost lane 13, and other portions 12C. It is so constructed that the pattern width in the first direction D1 of the first and second portions 12A and 12B is partially smaller than the pattern width in the first direction D1 of the respective other portions 12C in the insulating pattern 12. Therefore, increase in the thickness of the dielectric layer 3 at the outermost lanes 13 to be caused by increasing the area of one ends 32 (X) and 32 (Y) of the bus electrodes 2, can be reduced by the notch portions of the first and second portions 12A and 12B, thereby suppressing swell of the surface 3S of the dielectric layer 3 at the respective outermost lanes 13. Accordingly, a gap to be caused locally between the top of the barrier rib 7 and the surface 4S of the cathode film 4, as described in the foregoing first modification, can also be minimized with this modification, thereby reinforcing isolation of discharge between adjacent lanes.

As an insulating pattern forming part of the dielectric layer 3, there are, in addition to the insulating pattern 12 of light resistance as shown in FIGS. 7 and 8, the following patterns (i) and (ii):

(i) An insulating pattern formed in the vicinity of the boundary between adjacent scanning lines so that swell of the surface 3S of the dielectric layer 3 is facilitated at this boundary, in order to reinforce isolation of discharge between the adjacent scanning lines; and (ii) RGB color filter pattern to be incorporated into the dielectric layer 3 in response to the pattern alignment of three (R,G and B) phosphors 8, in order that quality of display is improved by considerably absorbing exterior light while allowing for transmittance of luminescence of each of the phosphors 8.

Even with a surface discharge AC type PDP using the above insulating pattern (i) or (ii), it is able to reduce the cross-sectional area of the dielectric layer 3 at the respective outermost lanes 13 thereby to suppress swell of the surface 3S of the dielectric layer 3, by reducing the density of the pattern area of the insulating pattern in the vicinity of one ends 32 (X) and 32 (Y) of the bus electrode 2 (i.e., by partially reducing the pattern width), as shown in FIG. 7. Thus, the above-mentioned gap to be locally caused between the top of the barrier rib 7 and the surface 4S of the cathode film 4 can be reduced thereby to reinforce isolation of discharge between adjacent lanes in the vicinity of the boundaries between the display region 21 and the non-display region 22 (the first and second boundaries B1 and B2).

Third Preferred Embodiment

Figure 13:
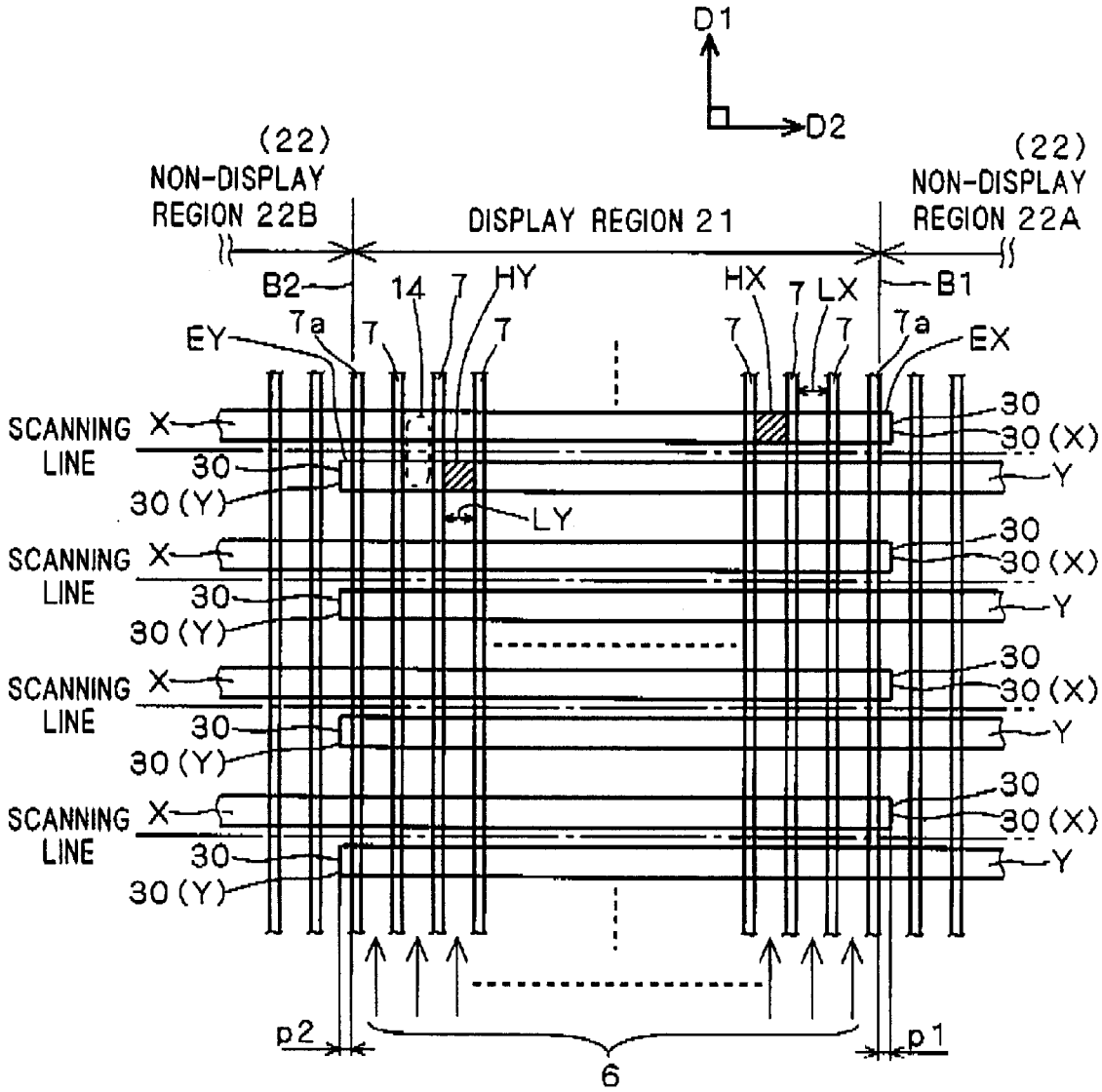
FIG. 13 is a plan view of a construction in the vicinity of the boundary between a display region and a non-display region in a surface discharge AC type PDP according to a third preferred embodiment of the invention.

FIG. 13 is a plan view illustrating schematically a construction at the boundary between a display region 21 and a first non-display region 22A adjacent to the region 21 with respect to a second direction D2, and at the boundary between the display region 21 and a second non-display region 22B adjacent to the region 21, when a surface discharge AC type PDP according to a third preferred embodiment is viewed from the display surface. Note that each of the non-display regions 22A and 2213 is also referred to simply as a non-display region 22.

As shown in FIG. 13, a first characteristic feature of this embodiment is that a first end 30 (X) of a first sustain discharge electrode X is disposed in the non-display region 22A in the vicinity of one outermost (a first outermost) barrier rib 7*a* defining the range of the display region 21 in the second direction D2. Further, the area of an extending portion EX of the first sustain discharge electrode X, which extends from a first boundary B1 to the first non-display region 22A in the second direction D2, is smaller than the area of a portion HX of the first sustain discharge electrode X (indicated by slant lines in FIG. 13) in a discharge cell 14 within the display region 21. In other words, a first dimension B1 in the second direction D2 that indicates the distance (which is also referred to as the amount of projection or the length of extension) from the side wall on the side of the non-display region of the first outermost barrier rib 7*a* (or from a first boundary B1) to the first end 30 (X) is smaller than length LX in the second direction D2 of the portion HX of the first sustain discharge electrode X.

A second characteristic feature of this embodiment is that a first end 30 (Y) of a second sustain discharge electrode Y is disposed in the non-display region 22B in the vicinity of the other outermost (a second outermost) barrier rib 7*a* defining the range of the display region 21 in the second direction D2. Further, the area of an extending portion EY of the second sustain discharge electrode Y, which extends from a second boundary B2 to the second non-display region 22B in the second direction D2, is smaller than the area of a portion HY of the second sustain discharge electrode Y (indicated by slant lines in FIG. 13) in the discharge cell 14 within the display region 21. In other words, a second dimension p2 in the second direction D2 that indicates the distance (which is also referred to as the amount of projection or the length of extension) from the side wall on the side of the non-display region of the second outermost barrier rib 7*a* (or from a second boundary B2) to the first end 30 (Y) is smaller than length LY in the second direction D2 of the portion HY of the second sustain discharge electrode Y.

It is, of course, possible to employ only one of the first and second characteristic features. However, it should be noted that the resulting effect is reduced by half, than the case of employing both as shown in FIG. 13.

Hereinafter, each of the first ends 30 (X) and 30 (Y) in FIG. 13 is referred to simply as a first end 30. For the sake of convenience, each of the first and second dimensions p1 and p2 is referred to simply as a dimension p, and the dimensions p1 and p2 may be the same or different.

The reason for and advantage of employing the first and second characteristic features are as follows. That is, with the construction of FIG. 13, sustain discharge electrode pairs (X, Y) extend in the non-display region 22 by the amount of extension given by the length p in the second direction D2. Therefore, disposition of the first end 30 in the non-display region 22 causes the risk of accidental sustain discharge in the non-display region 22. However, (I) when the extension dimensions p1 and p2 are set to be shorter than the length LX and LY, respectively, the electrode area of the extension portion EX of the first sustain discharge electrode X in the non-display region 22A and the electrode area of the extension portion EY of the second sustain discharge electrode Y in the non-display region 22B are smaller than the electrode area of the portion HX and the electrode area of the portion HY in the display region 21, respectively. Accordingly, as far as such dimensional setting is employed, even if the first end 30 is disposed in the non-display region 22, it is unavoidable that in the non-display region 22 near the respective outermost barrier ribs 7*a*, the electric field strength generated near the surface of the cathode film 4 by applying voltage to the sustain discharge electrode pair (X, Y) is weakened. In addition, (II) since the dielectric constant of the material forming the barrier ribs 7 and 7*a* is far higher than that of discharge gas, line of electric force is exerted into the outermost barrier rib 7*a* in the discharge space near the outermost barrier rib 7*a*, thereby to reduce the density of equipotential surface on the surface of the cathode film 4 in the vicinity of the outermost barrier rib 7*a* Therefore, it is unavoidable that in the non-display region 22 near the respective outermost barrier ribs 7*a*, the electric field strength generated near the surface of the cathode film 4 by applying voltage to the sustain discharge electrode pair (X, Y) is weakened. Accordingly, when the extension dimension p is set properly based on these points (I) and (II), it can be made impossible to obtain electric field strength necessary for accidental sustain discharge in the non-display region 22 near the outermost barrier rib 7*a*, even if the usual drive voltage is applied to the respective sustain discharge electrode pairs (X, Y).

In experiments using a sample in which, for example, the alignment pitch of the barrier rib 7 in the second direction D2 is 330 μm and the width of the barrier rib 7 in the second direction D2 is 80 μm, it has been shown that when the extension length p is 200 μm, it was considerably hard to cause accidental sustain discharge in the non-display region 22, and that when the extension length p is 80 μm, no accidental sustain discharge occurred. Thus, in the third preferred embodiment it is suitable to set the extension length p to 200 μm or less, desirably 100 μm or less.

With the construction described in this embodiment, even if sustain discharge electrode pairs (X, Y) are present in a certain range in the non-display region 22, accidental sustain discharge can be avoided or sufficiently suppressed. This is true for the construction according to the first preferred embodiment and its modifications. From these results, it can be said that the relative positioning in the second direction D2 between the outermost barrier rib 7*a* and the first end 30 in the display region 21 has a large tolerance. That is, the tolerance of the position of the first end 30 is from the state that the first end 30 passes through the outermost barrier rib 7*a* and extends to a certain range in the non-display region 22, as shown in FIG. 13, to the state that the first end 30 falls within the outermost lane 13 in the display region 21 without reaching the outermost barrier rib 7*a*, as described in the second modification of the first preferred embodiment.

The following results was confirmed by experiments using a sample in which, for example, the alignment pitch of the barrier rib 7 in the second direction D2 is 330 μm and the width of the barrier rib 7 in the second direction D2 is 80 μm. That is, even in the state that the first end 30 passes through the outermost barrier rib 7*a* and extends in the non-display region 22 by the length of 80 μm, or even in the state that the first end 30 does not reach the outermost barrier rib 7*a* and is present at a position in the outermost lane 13 that is located 60 μm inwardly from the side wall on the side of the display region of the outermost barrier rib 7*a*, there occurred no problem of quality of display in the vicinity of the boundary between the display region 21 and non-display region 22. Therefore, the tolerance amounts to at least 220 μm when the width of 80 μm of the outermost barrier rib 7*a* is included. Since this is an alignment precision that can be realized easily, it can be said that the present invention is again superior to other conventional techniques in the practicability of suppressing accidental sustain discharge in the non-display region 22.

Instead of the foregoing definition, the sustain discharge electrodes X and Y may be called "second and first sustain discharge electrodes", respectively. With this definition, boundaries B1 and B2 are called "second and first boundaries", respectively. Similarly, non-display regions 22A and 22B are called "second and first non-display regions", respectively. Such definitions are also applicable to the following modifications of the third preferred embodiment.

First Modification of Third Preferred Embodiment

In FIG. 13, since the shape of the lateral cross section of the extension portions EX and EY (i.e., a cross section parallel to a plane including the first and second directions D1 and D2) is a rectangle, the electrode area of the extension portions EX and EY is made smaller than the electrode area of the display region portions HX and HY, by setting the extension length p1 and p2 in the second direction D2 so as to be shorter than lengths LX and LY of the display region portions HX and HY, respectively.

Figure 14:
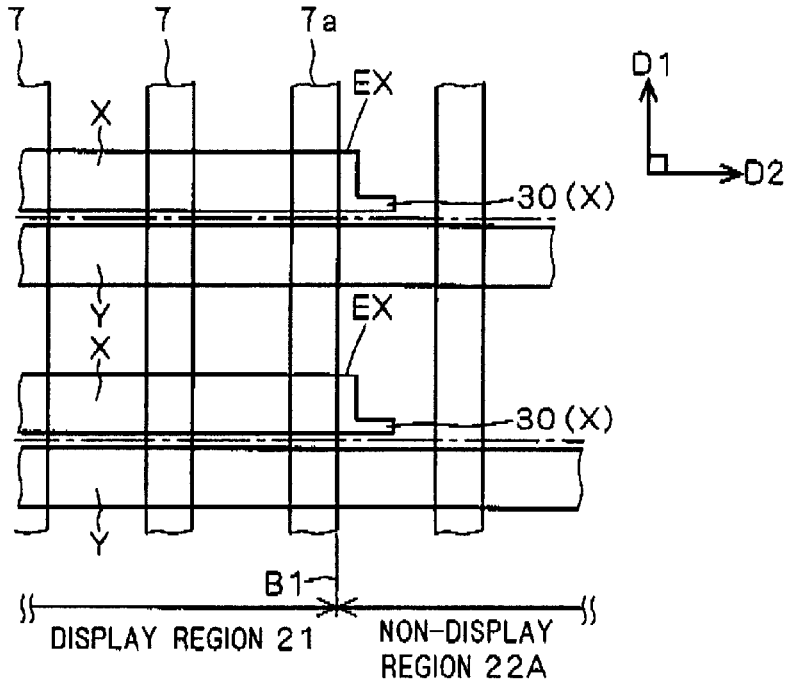
FIGS. 14 and 15 are plan views illustrating the end shape of a sustain discharge electrode in a surface discharge AC type PDP according to a first modification of the third preferred embodiment.
Figure 15:
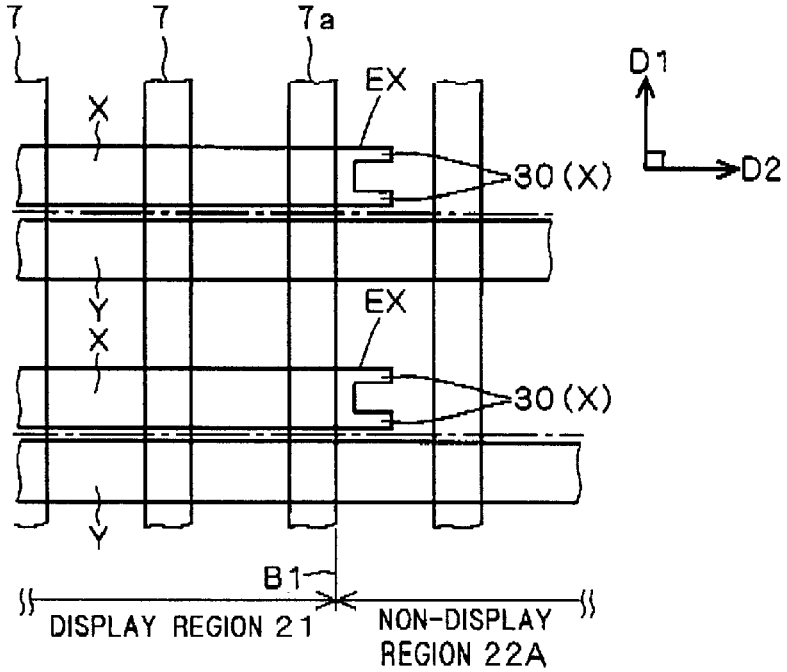

In contrast, as shown in FIG. 14 or FIG. 15, the electrode area of the extension portion EX may be made smaller than the electrode area of the display region portion HX by partially removing the electrode of the extension portion EX with respect to the first direction D1. Hereat, the lateral cross section of the extension portion EX in FIG. 14 is in L shape, and the lateral cross section of the extension portion EX in FIG. 15 is a concave that is recessed in the second direction D2. Note that the shape of the extension portion EX obtained by partial removal in the first direction D1 is not limited to these shapes.

Similarly, the extension portion EY may be partially removed in the first direction D1, though not illustrated in FIG. 14 or 15.

Second Modification of Third Preferred Embodiment

The electrode area of the portion of the other sustain discharge electrode paired with the extension portion (extension length p) of one sustain discharge electrode in the non-display region 22 in the vicinity of the outermost barrier rib 7*a*, may be set to be smaller than the electrode area of the portions (HX, HY) in a discharge cell 14 in the display region 21 of the other sustain discharge electrode. With this construction, it is able to further suppress accidental sustain discharge.

Figure 16:
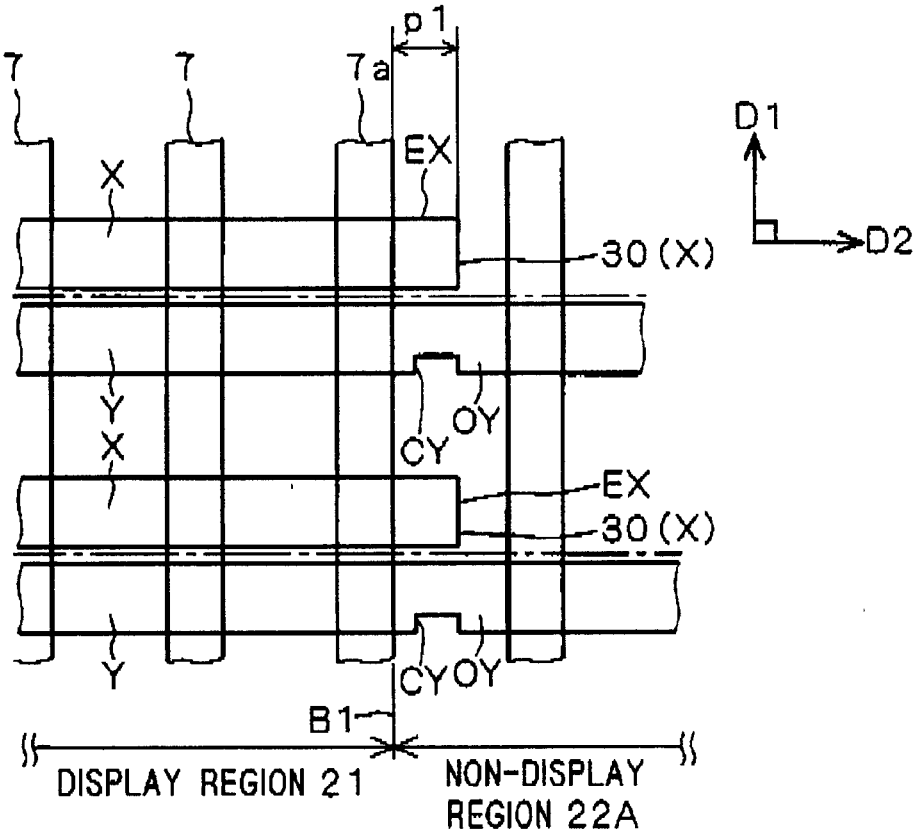
FIG. 16 is a plan view illustrating the end shape of one sustain discharge electrode and the end shape of the other sustain discharge electrode in a surface discharge AC type PDP according to a second modification of the third preferred embodiment.

FIG. 16 shows an example of this construction. In FIG. 16, a portion OY of the second sustain discharge electrode Y in the non-display region 22A, which is opposed to the extension portion EX of the first sustain discharge electrode X in the first direction D1, has a concave CY that is recessed in the first direction D1.

Third Modification of Third Preferred Embodiment

Figure 17:
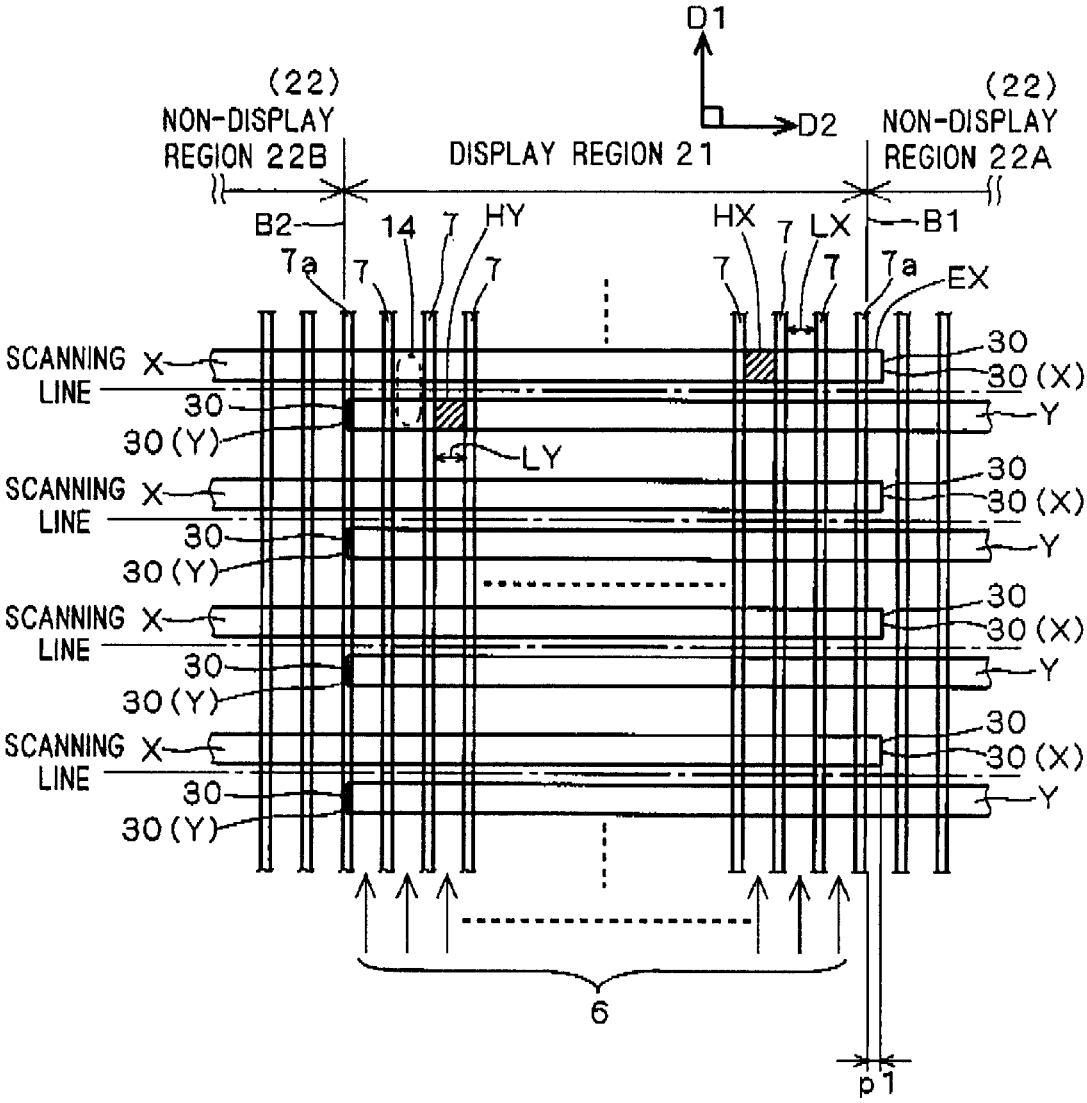
FIG. 17 is a plan view of a construction in the vicinity of the boundary between a display region and a non-display region in a surface discharge AC type PDP according to a third modification of the third preferred embodiment.

It may be constructed such that one of the third preferred embodiment and its modifications is applied to the first end 30 of either of the first and second sustain discharge electrodes X and Y, and one of the first preferred embodiment and its modifications is applied to the first end 30 of the other sustain discharge electrode. FIG. 17 is a plan view illustrating an example of such construction.

Fourth Preferred Embodiment

Figure 18:
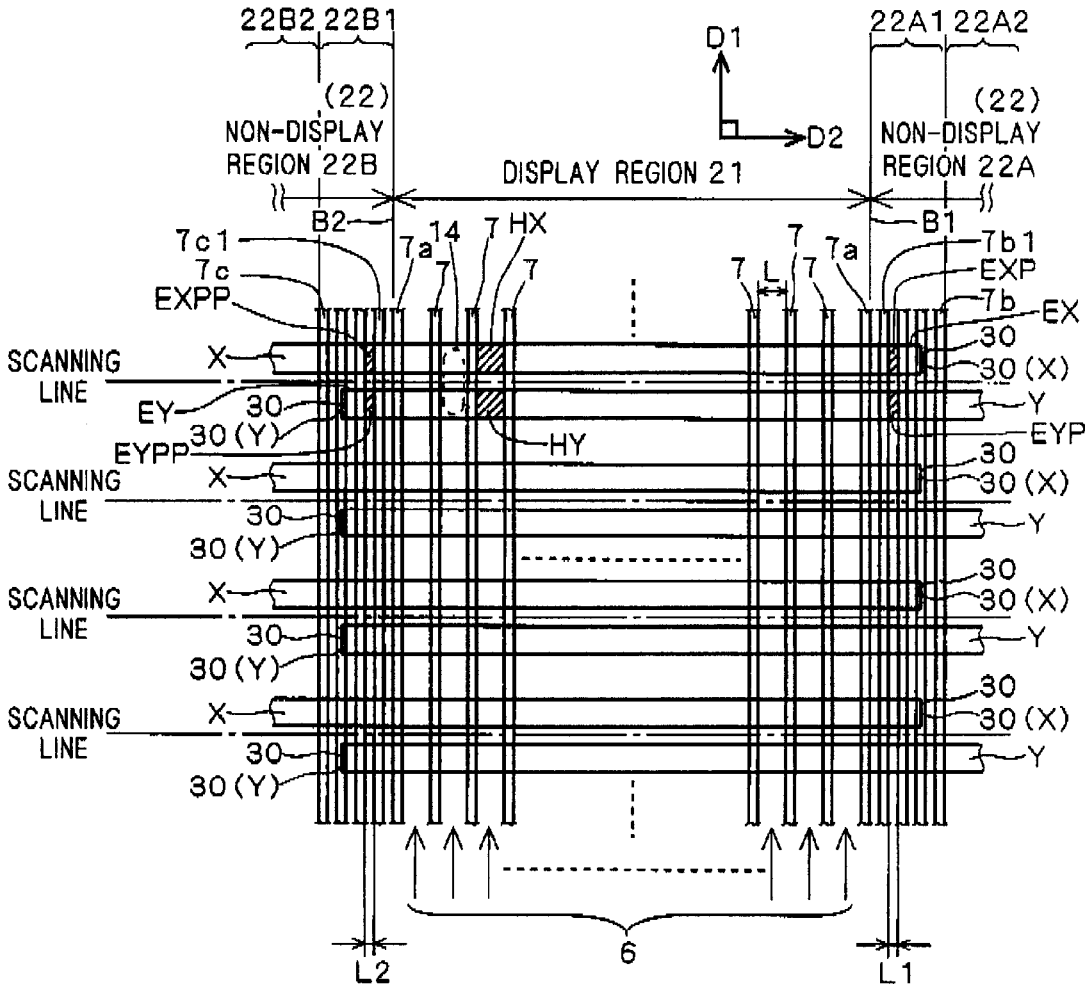
FIG. 18 is a plan view of a construction in the vicinity of the boundary between a display region and a non-display region in a surface discharge AC type PDP according to a forth preferred embodiment of the invention.

FIG. 18 is a plan view illustrating schematically a construction at a first boundary B1 between a display region 21 and a first non-display region 22A adjacent to the region 21 with respect to a second direction D2, and at a second boundary B2 between the display region 21 and a second non-display region 22B adjacent to the region 21, when a surface discharge AC type PDP according to a fourth preferred embodiment is viewed from the display surface. Note that each of the non-display regions 22A and 22B is also referred to simply as a non-display region 22.

As shown in FIG. 18, the first non-display region 22A has (i) a first region 22A1 adjacent to the display region 21 in the second direction D2, and (ii) a second region 22A2 adjacent to the first region 22A1 in the second direction D2. In the first region 22A1, there are disposed a plurality of second barrier ribs 7*b* that extend in the first direction D1 and are aligned in the second direction D2. In the fourth preferred embodiment, each of the barrier ribs 7 in the display region 21 is referred to as a first barrier rib. In contrast, no barrier rib is present in the second region 22A2. Similarly, the second non-display region 22B has (i) a first region 22B1 adjacent to the display region 21 in the second direction D2, and (ii) a second region 22B2 adjacent to the first region 22B1 in the second direction D2. In the first region 22B1, there are disposed a plurality of third barrier ribs 7*c* that extend in the first direction D1 and are aligned in the second direction D2. In contrast, no barrier rib is present in the second region 22B2.

Referring to FIG. 18, a first characteristic feature of the fourth preferred embodiment comprises (I) a first end 30 (X) of a first sustain discharge electrode X is disposed in the first region 22A1 of the first non-display region 22A, and (II) an interval L1 between the second barrier ribs 7*b* adjacent to each other in the first region 22A1, and an interval L1 between a second barrier rib 7*b*1 adjacent to a first outermost barrier rib 7*a* defining the first boundary B1 in the plural second barrier ribs 7*b*, and the barrier rib 7*a*, are both set to be narrower than an interval L between the first barrier ribs 7 adjacent to each other.

The construction obtained by the feature (II) will be fully described as follows: (II-i) a space entirely opposed to a portion EXP defined by the opposite side walls of the adjacent second barrier ribs 7*b*1 in an extension portion EX of the first sustain discharge electrode X extending from the first boundary B1 to the first region 22A1, in a second discharge space defined in the second direction D2 by the adjacent second barrier ribs 7*b*1, and (II-ii) a space entirely opposed to the portion EXP of the first sustain discharge electrode X in the second discharge space defined by the first outermost barrier rib 7*a* and the second barrier rib 7*b*1, are both set to he narrower than a space entirely opposed to a portion HX of the first sustain discharge electrode X within the display region 21 in a first discharge space defined in the second direction D2 by the adjacent first barrier ribs 7 within the display region 21. Similarly, (II-iii) a space entirely opposed to a portion EYP defined by the opposite side walls of the adjacent second barrier ribs 7*b*1 in the second sustain discharge electrode Y present within the first region 22A1 in the second discharge space defined by the adjacent second barrier ribs 7*b*1, and (II-iv) a space entirely opposed to the portion EYP of the second sustain discharge electrode Y in the second discharge space defined by the first outermost barrier rib 7*a* and the second barrier rib 7*b*1, are both set to be narrower than a space entirely opposed to a portion HY of the second sustain discharge electrode Y within the display region 21.

A second characteristic feature of the fourth preferred embodiment comprises (I) a first end 30 (Y) of a second sustain discharge electrode Y is disposed in the first region 22B1 of the second non-display region 22B, and (II) an interval L2 between the adjacent third barrier ribs 7*c* in the first region 22B1, and an interval L2 between a third barrier rib 7*c*1 adjacent to the second outermost barrier rib 7*a* defining the second boundary B2 in plural third barrier ribs 7*c* and the barrier rib 7*a*, are set to be narrower than an interval L between the adjacent first barrier ribs 7.

The construction obtained by the feature (II) will be fully described as follows: (II-i) a space entirely opposed to a portion EYPP defined by the opposite side walls of the adjacent third barrier ribs 7*c*1 in the extension portion EY of the second sustain discharge electrode Y extending from the second boundary B2 to the first region 22B1, in a third discharge space within the first region 22B1 defined in the second direction D2 by the adjacent third barrier ribs 7*c*1, and (II-ii) a space entirely opposed to the portion EYPP of the second sustain discharge electrode Y in the third discharge space defined by the second outermost barrier rib 7*a* and the third barrier rib 7*c*1, are both set to be narrower than a space entirely opposed to the portion RY of the second sustain discharge electrode Y within the display region 21. Similarly, (II-iii) a space entirely opposed to a portion EXPP defined by the opposite side walls of the adjacent third barrier ribs 7*c*1 in the first sustain discharge electrode X present within the first region 22B1, in the third discharge space defined by the adjacent third barrier ribs 7*c*1, and (II-iv) a space entirely opposed to the portion EXPP of the first sustain discharge clectrodc X in the third discharge space defined by the second outermost barrier rib 7*a* and the third barrier rib 7*c*1, are both set to be narrower than a space entirely opposed to the portion HX of the first sustain discharge electrode X within the display region 21.

It is, of course, possible to employ only one of the first and second characteristic features. However, it should be noted that the resulting effect is reduced by half, than the case of employing both as shown in FIG. 18.

Thus, in the fourth preferred embodiment, the widths L1 and L2 in the second direction D2 of the respective discharge spaces in the first regions 22A1 and 22B1 of the non-display region 22 are smaller than the width L in the second direction D2 of a first discharge space 14 in the display region 21. The reason or idea for employing such a construction is as follows. In general, the relative dielectric constant of a barrier rib is about 10 and is approximately the same as that of the dielectric layer 3. In contrast, the relative dielectric constant of discharge gas is about 1 and is sufficiently smaller than that of the barrier rib. Therefore, from the same reason as described at the point (II) in the third preferred embodiment, as the spaced interval between adjacent barrier ribs is narrower, i.e., as a discharge space is narrower, the electric field strength generated in the discharge space near the surface of the cathode film 4 is more weakened when a drive voltage is applied to each sustain discharge pair (X, Y). This action is utilized at each non-display region 22, thus leading to the first and second characteristic features.

Thus in the fourth preferred embodiment, occurrence of accidental sustain discharge can be suppressed although the sustain discharge electrode pairs (X, Y) are present in the non-display region 22.

Instead of the foregoing definition, the sustain discharge electrodes X and Y may be called "second and first sustain discharge electrodes", respectively. With this definition, boundaries B1 and B2 are called "second and first boundaries", respectively. Similarly, non-display regions 22A and 22B are called "second and first non-display regions", respectively. In addition, the barrier ribs 7*b* and 7*c* are called "third and second barrier ribs", respectively. Such definitions is also applicable to the following modifications of the fourth preferred embodiment.

First Modification of Fourth Preferred Embodiment

The technical idea of the fourth preferred embodiment is also applicable to a surface discharge AC type PDP having lattice-like barrier ribs. With such a modification, in both of the display region 21 and non-display region 22, the discharge space of each discharge cell is defined not only in the second direction D2 but also in the first direction D1, resulting in the closed space. In this modification, the dimension of the lattice-like barrier ribs is set so that each discharge space in the non-display region 22 is narrower than that in the display region 21. This modification will be fully described by referring to drawings.

Figure 19:
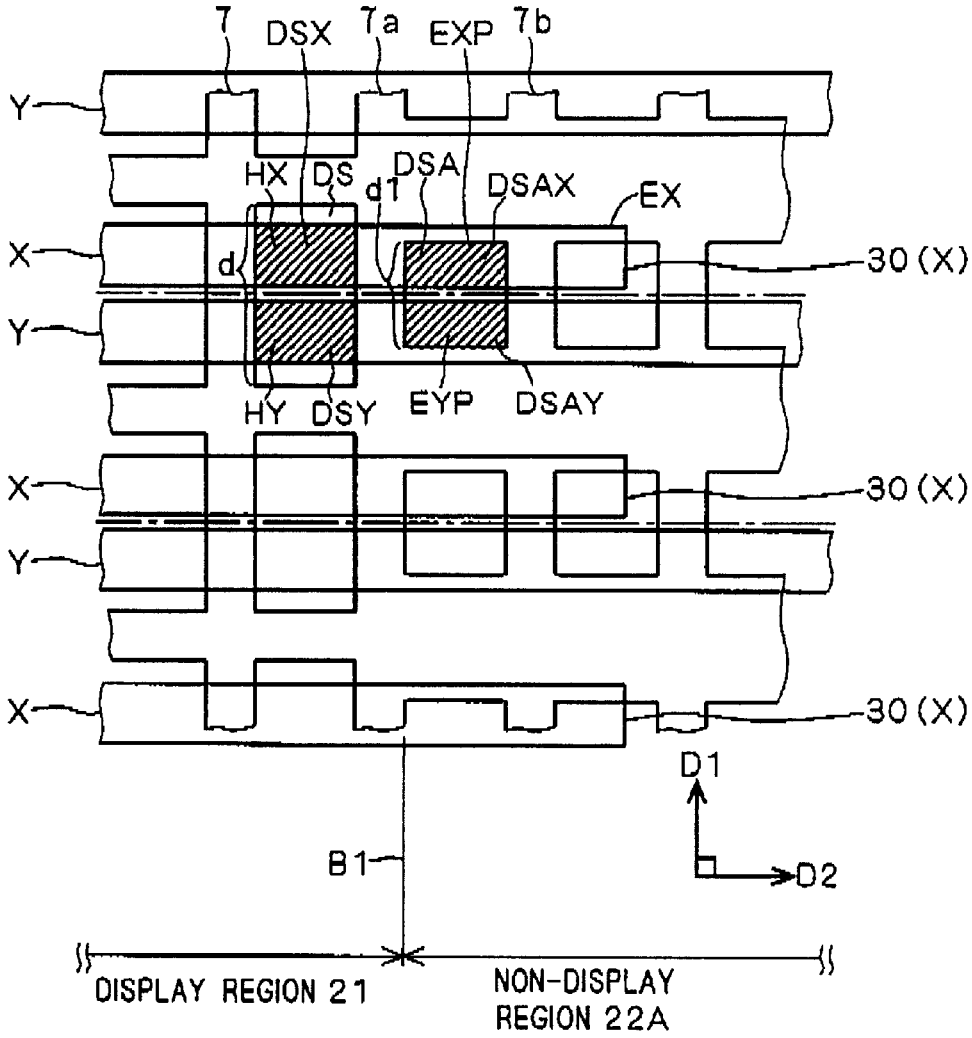
FIGS. 19 and 20 are plan views illustrating the barrier rib shape in the vicinity of the boundary between a display region and a non-display region in a surface discharge AC type PDP according to a first modification of the forth preferred embodiment.

FIG. 19 is a plan view schematically illustrating a construction in the vicinity of a first boundary B1 between a first non-display region 22A and the display region 21. As shown in FIG. 19, both of a barrier rib 7 in the display region 21 and a barrier rib 7*b* in the first non-display region 22A are lattice-like barrier ribs, and the both 7 and 7*b* are formed integrally. However, length d1 in the first direction D1 of a discharge space DSA within the first non-display region 22A surrounded by the barrier ribs 7*b* in all directions, is smaller than length d in the first direction D1 of a discharge space DS within the display region 21 surrounded by the barrier ribs 7 in all directions. Therefore, a space DSAX entirely opposed to a portion EXP (indicated by hatching in FIG. 19) which is defined in the second direction D2 by both barrier rib portions extending in the first direction D1 within an extension portion EX of the first sustain discharge electrode X in the discharge space DSA of the first non-display region 22A, is narrower than a space DSX entirely opposed to a portion HX (indicated by hatching in FIG. 19) of the first sustain discharge electrode X within the discharge space DS of the display region 21. Similarly, a space DSAY entirely opposed to a portion EYP (indicated by hatching in FIG. 19) of the second sustain discharge electrode Y in the discharge space DSA of the first non-display region 22A is narrower than a space DSY entirely opposed to a portion HY (indicated by batching in FIG. 19) of the second sustain discharge electrode Y within the discharge space DS of the display region 21.

The same construction as shown in FIG. 19 is also applicable to the construction in the vicinity of the second boundary B2 between the second non-display region 22B and display region 21, though it is not illustrated.

It is apparent that this modification having the above-mentioned construction can provide the action of weakening electric field strength and the effect of suppressing occurrence of accidental sustain discharge, as described in the fourth preferred embodiment.

Figure 20:
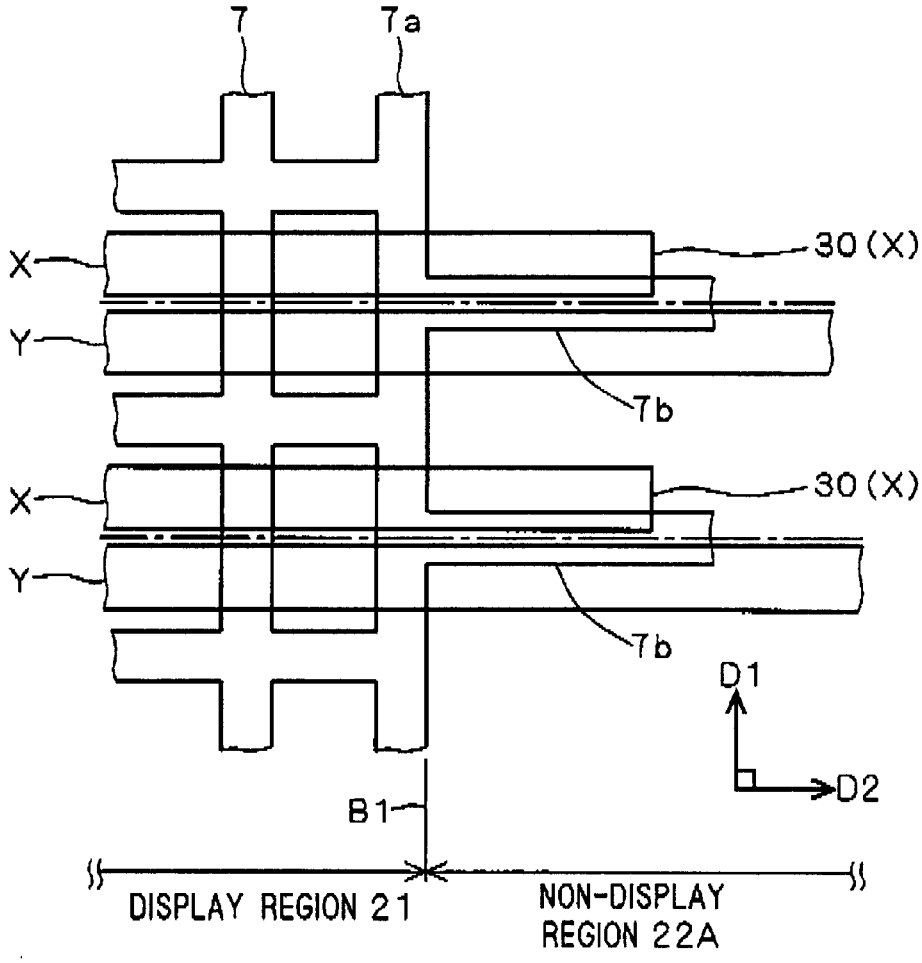

Alternatively, as shown in FIG. 20, the same resulting effect can be obtained even when the barrier ribs 7*b* are disposed below or above the interval portion between the paired first and second sustain discharge electrodes X and Y in the non-display region 22. The construction shown in FIG. 20 corresponds to the ultimate modification of that in FIG. 19, which corresponds to the case of having no discharge space DSA shown in FIG. 19.

Second Modification of Fourth Preferred Embodiment

Figure 21:
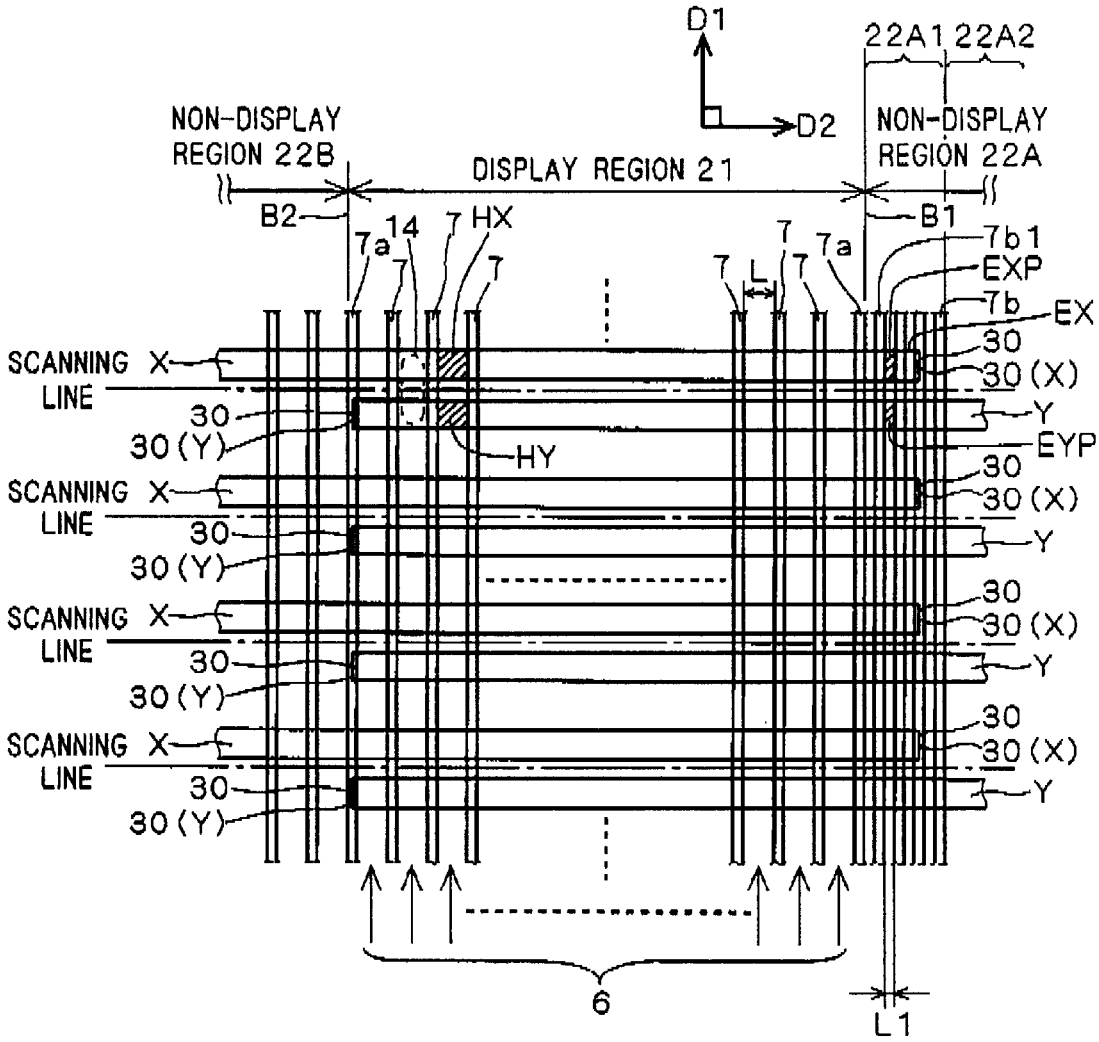
FIG. 21 is a plan view of a construction in the vicinity of the boundary between a display region and a non-display region in a surface discharge AC type PDP according to a second modification of the forth preferred embodiment.

It may be constructed such that one of the third preferred embodiment and its first modification is applied to the first end 30 of either of the first and second sustain discharge electrodes X and Y, and one of the first preferred embodiment and its modifications, or, one of the second preferred embodiment and its modifications, is applied to the first end 30 of the other sustain discharge electrode. FIG. 21 is a plan view illustrating an example of such construction.

While the invention has been shown and described in detail, the foregoing description is in all aspects illustrative and not restrictive. It is therefore understood that numerous modifications and variations can be devised without departing from the scope of the invention.

What is claimed is:

1. A substrate, said substrate being used for a surface discharge AC type plasma display panel wherein a discharge cell is formed by each intersecting point of each lane and each scanning line, said each lane being partitioned by barrier ribs adjacent to each other within a plurality of barrier ribs provided to extend in a first direction and being associated with drive of an address electrode corresponding to said barrier ribs adjacent to each other within a plurality of address electrodes provided to extend in said first direction, and said each scanning line being defined by an arbitrary sustain discharge electrode pair within a plurality of sustain discharge electrode pairs provided to extend in a second direction orthogonal to said first direction, and a continuous display region defines said discharge cell aligned in matrix, said substrate comprising:

a substrate body;

said plurality of sustain discharge electrode pairs formed on said substrate body;

a dielectric layer formed on said substrate body and covering said plurality of sustain discharge electrode pairs; and a cathode film formed on said dielectric layer, wherein each of said plurality of sustain discharge electrode pairs comprises first and second sustain discharge electrodes opposed to each other at a predetermined spaced interval, in first and second non-display regions with respect to said second direction adjacent to said display region, one end of said first sustain discharge electrode is not present within said first non-display region and is present within said display region on the side of a boundary between said display region and said first non-display region, the other end of said first sustain discharge electrode is present within said second non-display region, one end of said second sustain discharge electrode is not present within said second non-display region and is present within said display region on the side of a boundary between said second non-display region and said display region, and the other end of said second sustain discharge electrode is present within said first non-display region.

2. The substrate according to claim 1, wherein said one end of said first sustain discharge electrode is present within said second non-display region, one end of said second sustain discharge electrode is not present within said second non-display region and is present within said display region on the side of a boundary between said second non-display region and said display region, and the other end of said second sustain discharge electrode is present within said first non-display region.

3. The substrate according to claim 2, wherein said first sustain discharge electrode comprises a first bus electrode, said second sustain discharge electrode comprises a second bus electrode, one end of said first bus electrode of said first sustain discharge electrode is present at a portion of said display region corresponding to one outermost lane adjacent to said boundary between said first non-display region and said display region, one end of said second bus electrode of said second sustain discharge electrode is present at a portion of said display region corresponding to the other outermost lane adjacent to said boundary between said second non-display region and said display region, said one end of said first bus electrode of said first sustain discharge electrode has a first pattern width greater than a pattern width of portions other than the mentioned one end of said first bus electrode with respect to said first direction, and said one end of said second bus electrode of said second sustain discharge electrode has a second pattern width greater than a pattern width of portions other than the mentioned one end of said second bus electrode with respect to said first direction.

4. The substrate according to claim 3, wherein in said first bus electrode of said first sustain discharge electrode, a pattern width of a portion present in said display region corresponding to said other outermost lane is partially smaller than a pattern width of a portion present in said display region corresponding to a lane adjacent to said other outermost lane, and in said second bus electrode of said second sustain discharge electrode, a pattern width of a portion present in said display region corresponding to said one outermost lane is partially smaller than a pattern width of a portion present in said display region corresponding to a lane adjacent to said one outermost lane.

5. The substrate according to claim 3, further comprising:

a plurality of insulating patterns being formed either on said substrate body or in said dielectric layer and extending between adjacent sustain discharge electrode pairs in said second direction, wherein in each of said plurality of insulating patterns, a pattern width in said first direction of a first portion present in said display region corresponding to said one outermost lane and a pattern width in said first direction of a second portion present in said display region corresponding to said other outermost lane are both partially thinner than a pattern width of portions other than said first and second portions of the insulating pattern with respect to said first direction.

6. A surface discharge AC type plasma display panel comprising:

a first panel being the substrate according to claim 2; and a second panel attached at its peripheral part to said first panel.

7. A surface discharge AC type plasma display device comprising:

the surface discharge AC type plasma display panel according to claim 8; and a drive unit configured to drive said surface discharge AC type plasma display panel.

8. The substrate according to claim 1, wherein said first discharge electrode comprises a first bus electrode, said second sustain discharge electrode comprises a second bus electrode, one end of said first bus electrode of said first sustain discharge electrode Is present at a portion of said display region which is located in the vicinity of said boundary between said first non-display region and said display region, one end of said second bus electrode of said second sustain discharge electrode is present at a portion of said display region which is located in the vicinity of said boundary between said second non-display region and said display region, said one end of said first bus electrode of said first sustain discharge electrode has a first pattern width greater than a pattern width of portions other than the mentioned one end of said first bus electrode with respect to said first direction, and said one end of said second bus electrode of said second sustain discharge electrode has a second pattern width greater than a pattern width of portions other than the mentioned one end of said second bus electrode with reaped to said first direction.

9. A substrate, said substrate being used for a surface discharge AC type plasma display panel wherein a discharge cell is formed by each intersecting point of each lane and each scanning line, said each lane being partitioned by barrier ribs adjacent to each other within a plurality of barrier ribs provided to extend in a first direction and being associated with drive of an address electrode corresponding to said barrier ribs adjacent to each other within a plurality of address electrodes provided to extend in said first direction, and said each scanning line being defined by an arbitrary sustain discharge electrode pair within a plurality of sustain discharge electrode pairs provided to extend in a second direction orthogonal to said first direction, and a continuous display region defines said discharge cell aligned in matrix, said substrate comprising:

a substrate body;

said plurality of sustain discharge electrode pairs formed on said substrate body;

a dielectric layer formed on said substrate body and covering said plurality of sustain discharge electrode pairs; and a cathode film formed on said dielectric layer, wherein each of said plurality of sustain discharge electrode pairs comprises first and second sustain discharge electrodes opposed to each other at a predetermined spaced interval, in first and second non-display regions with respect to said second direction adjacent to said display region, one end of said first sustain discharge electrode is not present within said first non-display region and is present within said display region on the side of a boundary between said display region and said first non-display region, and said one end of said first sustain discharge electrode is present at a portion of said display region corresponding to one outermost lane adjacent to said boundary between said first non-display region and said display region in a group of lane.

10. The substrate according to claim 3, wherein said one end of said second sustain discharge electrode is present at a portion of said display region corresponding to the other outermost lane adjacent to said boundary between said second non-display region and said display region in said group of lanes.

11. A substrate, said substrate being used for a surface discharge AC type plasma display panel wherein a discharge cell is formed by each intersecting point of each lane and each scanning line, said each lane being partitioned by barrier ribs adjacent to each other within a plurality of barrier ribs provided to extend in a first direction and being associated with drive of an address electrode corresponding to said barrier ribs adjacent to each other whithin a plurality of address electrodes provided to extend in said first direction, and said each scanning line being defined by an arbitrary sustain discharge electrode pair within a plurality of sustain discharge electrode pairs provided to extend in a second direction intersecting said first direction, and a continuous display region defines said discharge cell aligned in matrix, said substrate comprising:
a substrate body;
said plurality of sustain discharge electrode pairs formed on said substrate body;
a dielectric layer formed on said substrate body and covering said plurality of sustain discharge electrode pairs; and
a cathode film formed on said dielectric layer,
wherein each of said plurality of sustain discharge electrode pairs comprises first and second sustain discharge electrodes opposed to each other at a predetermined spaced interval,
first and second non-display regions are adjacent to said display region with respect to said second direction,
one end of said first sustain discharge electrode is disposed at a portion of said first non-display region which is located in the vicinity of a boundary between said display region and said first non-display region,
an extension portion of said first sustain discharge electrode extending in said second direction from said boundary to said one end is smaller in area than a portion of said first sustain discharge electrode at said discharge cell within said display region,
said second sustain discharge electrode extends in said second direction within said first non-display region and is opposed to said extension portion of said first sustain discharge electrode, and
said extension portion of said first sustain discharge electrode has a length of 200 $\mu$m or less in said second direction.

12. A surface discharge AC type plasma display panel comprising:
a first panel being the substrate according to claim 11; and
a second panel attached at its peripheral part to said first panel.

13. A surface discharge AC type plasma display device comprising:
the surface discharge AC type plasma display panel according to claim 12, and
a drive unit configured to drive said surface discharge AC type plasma display panel.

14. A substrate, said substrate being used for a surface discharge AC type plasma display panel wherein a discharge cell is formed by each intersecting point of each lane and each scanning line, said each lane being partitioned by barrier ribs adjacent to each other within a plurality of barrier ribs provided to extend in a first direction and being associated with drive of an address electrode corresponding to said barrier ribs adjacent to each other within a plurality of address electrodes provided to extend in said first direction, and said each scanning line being defined by an arbitrary sustain discharge electrode pair within a plurality of sustain discharge electrode pairs provided to extend in a second direction intersecting said first direction, and a continuous display region defines said discharge cell aligned in matrix,
said substrate comprising:
a substrate body;
said plurality of sustain discharge electrode pairs formed on said substrate body;
a dielectric layer formed on said substrate body and covering said plurality of sustain discharge electrode pairs; and
a cathode film formed on said dielectric layer,
wherein each of said plurality of sustain discharge electrode pairs comprises first and second sustain discharge electrodes opposed to each other at a predetermined spaced interval,
first and second non-display regions are adjacent to said display region with respect to said second direction,
one end of said first sustain discharge electrode is disposed at a portion of said first non-display region which is located in the vicinity of a boundary between said display region and said first non-display region,
an extension portion of said first sustain discharge electrode extending in said second direction from said boundary to said one end is smaller in area than a portion of said first sustain discharge electrode at said discharge cell within said display region, and
said second sustain discharge electrode extends in said second direction within said first non-display region and is opposed to said extension portion of said first sustain discharge electrode, and
a portion of said second sustain discharge electrode which is opposed to said extension portion of said first sustain discharge electrode in said first non-display region comprises a concave portion recessed in said first direction.

15. A substrate, said substrate being used for a surface discharge AC type plasma display panel wherein a discharge cell is formed by each intersecting point of each lane and each scanning line, said each lane being partitioned by barrier ribs adjacent to each other within a plurality of barrier ribs provided to extend in a first direction and being associated with drive of an address electrode corresponding to said barrier ribs adjacent to each other within a plurality of address electrodes provided to extend in said first direction, and said each scanning line being defined by an arbitrary sustain discharge electrode pair within a plurality of sustain discharge electrode pairs provided to extend in a second direction orthogonal to said first direction, and a continuous display region defines said discharge cell aligned in matrix,
said substrate comprising:
a substrate body;
said plurality of sustain discharge electrode pairs formed on said substrate body;
a dielectric layer formed on said substrate body and covering said plurality of sustain discharge electrode pairs; and
a cathode film formed on said dielectric layer,
wherein each of said plurality of sustain discharge electrode pairs comprises first and second sustain discharge electrodes opposed to each other at a predetermined spaced interval,
first and second non-display regions are adjacent to said display region with respect to said second direction,
one end of said first sustain discharge electrode is disposed at a portion of said first non-display region which is located in the vicinity of a boundary between said display region and said first non-display region,
an extension portion of said first sustain discharge electrode extending in said second direction from said boundary to said one end is smaller in area than a portion of said first sustain discharge electrode at said discharge cell within said discharge region,
said second sustain discharge electrode extends in said second direction within said first non-display region and is opposed to said extension portion of said first sustain discharge electrode, and one end of said second sustain discharge electrode is disposed at a portion of said second non-display region which is located in the vicinity of a boundary between said display region and said second non-display region, an extension portion of said second sustain discharge electrode extending in said second direction from said boundary between said display region and said second non-display region to said one end of said second sustain discharge electrode is smaller in area than a portion of said second sustain discharge electrode at said discharge cell within said display region, and said first sustain discharge electrode extends in said second direction within said second non-display region and is opposed to said extension portion of said second sustain discharge electrode.

16. A substrate, said substrate being used for a surface discharge AC type plasma display panel wherein a discharge cell is formed by each intersecting point of each lane and each scanning line, said each lane being partitioned by barrier ribs adjacent to each other within a plurality of barrier ribs provided to extend in a first direction and being associated with drive of an address electrode corresponding to said barrier ribs adjacent to each other within a plurality of address electrodes provided to extend in said first direction, and said each scanning line being defined by an arbitrary sustain discharge electrode pair within a plurality of sustain discharge electrode pairs provided to extend in a second direction intersecting said first direction, and a continuous display region defines said discharge cell aligned in matrix, said substrate comprising:

a substrate body;

said plurality of sustain discharge electrode pairs formed on said substrate body;

a dielectric layer formed on said substrate body and covering said plurality of sustain discharge electrode pairs; and a cathode film formed on said dielectric layer, wherein each of said plurality of sustain discharge electrode pairs comprises first and second sustain discharge electrodes opposed to each other at a predetermined spaced interval, first and second non-display regions are adjacent to said display region with respect to said second direction, a plurality of first discharge spaces extending in said first direction and being aligned in said second direction are disposed in said display region, said first non-display region comprising:

a first region adjacent to said display region with respect to said second direction; and a second region adjacent to said first region with respect to said second direction, a second region adjacent to said first region with respect to said second direction, wherein a plurality of second discharge spaces extending in said first direction and being aligned in said second direction are disposed in said first region, one end of said first sustain discharge electrode is disposed within said first region, said second sustain discharge electrode extends in said second direction within said first region and Mid second region, a space in each of said plurality of second discharge spaces which is opposed to a portion of said first sustain discharge stockade defining a discharge cell of the respective second discharge spaces is smaller than a space in each of said plurality of first discharge spaces which Is opposed to a portion of said first sustain discharge electrode defining said discharge cell of the respective first discharge spaces, and a space in each of said plurality of second discharge spaces which Is opposed to a portion of said second sustain discharge electrode defining said discharge cell of the respective second discharge spaces is smaller than a space in each of said plurality of first discharge spaces which is opposed to a portion of said second sustain discharge electrode defining said discharge cell of the respective first discharge spaces.

17. The substrate according to claim 16, wherein each of said plurality of second discharge spaces is smaller in width in said second direction than each of said plurality of first discharge spaces.

18. The substrate according to claim 16, said second non-display region comprising:

a first region adjacent to said display region with respect to said second direction; and a second region adjacent to said first region of said second non-display region with respect to said second direction, wherein a plurality of third discharge spaces extending in said first direction and being aligned in said second direction are disposed within said first region of said second non-display region, one end of said second sustain discharge electrode is disposed within said first region of said second non-display region, said first sustain discharge electrode extends in said second direction within said first region and said second region of said second non-display region, a space in each of said plurality of third discharge spaces which is opposed to a portion of said second sustain discharge electrode defining a discharge cell within the respective third discharge spaces is smaller than a space in each of said plurality of first discharge spaces which is opposed to a portion of said second sustain discharge electrode defining said discharge cell within the respective first discharge spaces, and a space in each of said plurality of third discharge space which is opposed to a portion of said second sustain discharge electrode defining a discharge cell within the respective third discharge spaces is smaller than a space in each of said plurality of first discharge spaces which is opposed to a portion of said second sustain discharge electrode defining said discharge cell within the respective first discharge spaces, and a space in each of said plurality of third discharge spaces which is opposed to a portion of said first sustain discharge electrode defining said discharge cell within the respective third discharge spaces is smaller than a space in each of said plurality of first discharge spaces which is opposed to a portion of said first sustain discharge electrode defining said discharge cell within the respective flint discharge spaces.

19. A surface discharge AC type plasma display panel comprising:

a first panel being the substrate according to claim 18; and a second panel attached at its peripheral part to said first panel.

20. A surface discharge AC type plasma display device comprising:

the surface discharge AC type plasma display panel according to claim 19; and a drive unit configured to drive said surface discharge AC type plasma display panel.

21. A substrate according to claim 16, wherein each of said plurality of second discharge spaces is smaller in length in said first direction than each of said plurality of first discharge spaces.

* * * * *

UNITED STATES PATENT AND TRADEMARK OFFICE

CERTIFICATE OF CORRECTION

PATENT NO. : 6,646,375 B1
DATED : November 11, 2003
INVENTOR(S) : Shinichiro Nagano It is certified that error appears in the above-identified patent and that said Letters Patent is hereby corrected as shown below:

Column 2,
Lines 18-19, change “ribs 7” to -- ribs 7a --;

Column 10,
Line 17, change “Modification” to -- modification --;

Column 12,
Line 4, change “2213” to -- 22B --;

Column 13,
Lines 64-65, change “bum-out” to -- burn-out --;

Column 14,
Line 2, change “bum-out” to -- burn-out --;

Column 19,
Line 20, change “S” to -- 5 --;
Line 40, change “One” to -- one --;

Column 21,
Line 52, change “2213” to -- 22B --;
Line 66, change “B1” to -- p1 --;

Column 22,
Line 62, change “7a” to -- 7a. --;

Column 25,
Lines 27, 31, 41, and 44, change “7b1” to -- 7b --;
Line 64, change “7c1” to --7c--;

Column 26,
Lines 1, 10, and 12, change “7c1” to -- 7c --;
Line 6, change “RY” to -- HY --;

Column 27,
Line 52, change “third” to -- fourth --;
Line 56, change “second” to -- third --;

UNITED STATES PATENT AND TRADEMARK OFFICE

CERTIFICATE OF CORRECTION

PATENT NO. : 6,646,375 B1
DATED : November 11, 2003
INVENTOR(S) : Shinichiro Nagano It is certified that error appears in the above-identified patent and that said Letters Patent is hereby corrected as shown below:

Column 28,
Line 11, change "orthogonal to" to -- intersecting --;
Lines 42-52, please delete in its entirety and replace it with the following:
-- 2. The substrate according to claim 1, wherein said one end of said first sustain electrode is present at a portion of said display region corresponding to one outermost barrier rib defining said boundary between said first non-display region and said display region is said plurality of barrier ribs, and said one end of said second sustain discharge electrode is present at a portion of said display region corresponding to the other outermost barrier rib defining said boundary between said second non-display region and said display region in said plurality of barrier ribs. --

Column 29,
Line 41, change "claim 2" to -- claim 1 --;
Line 47, change "claim 8" to -- claim 6 --;
Line 57, change "Is" to -- is --;

Column 30,
Line 20, change "orthogonal to" to -- intersecting --;
Line 47, change "claim 3" to -- claim 9 --;

Column 32,
Line 15, delete "and";
Line 37, change "orthogonal to" to -- intersecting --;
Line 67, delete "and";

Column 33,
Lines 55 and 56, please delete in its entirety;
Line 63, change "Mid" to -- said --;
Line 67, change "stockage" to -- electorde --;

UNITED STATES PATENT AND TRADEMARK OFFICE

CERTIFICATE OF CORRECTION

PATENT NO. : 6,646,375 B1
DATED : November 11, 2003
INVENTOR(S) : Shinichiro Nagano It is certified that error appears in the above-identified patent and that said Letters Patent is hereby corrected as shown below:

Column 34,
Lines 3 and 8, change "Is" to -- is --;
Lines 46-53, please delete;
Line 62, change "flint" to -- first --; and
Line 65, change "claim 18" to -- claim 16 --.

Signed and Sealed this

Twentieth Day of July, 2004

JON W. DUDAS
*Acting Director of the United States Patent and Trademark Office*